US008330101B2

(12) United States Patent
Seyfarth

(10) Patent No.: US 8,330,101 B2
(45) Date of Patent: Dec. 11, 2012

(54) SYSTEM AND METHOD FOR REPLACING AN ION SOURCE IN A MASS SPECTROMETER

(75) Inventor: Carolyn Broadbent Seyfarth, Los Altos, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 253 days.

(21) Appl. No.: 12/689,427

(22) Filed: Jan. 19, 2010

(65) Prior Publication Data

US 2011/0174969 A1 Jul. 21, 2011

(51) Int. Cl.
*H01J 49/14* (2006.01)

(52) U.S. Cl. ..... 250/288; 250/289; 250/423 R; 250/424; 250/427

(58) Field of Classification Search ..... 250/288, 250/289, 423 R, 424, 427
See application file for complete search history.

(56) References Cited

U.S. PATENT DOCUMENTS 3,115,591 A * 12/1963 Brunnee ..... 250/427
3,117,223 A * 1/1964 Brunnee ..... 250/288
4,388,531 A * 6/1983 Stafford et al. ..... 250/427
5,313,061 A * 5/1994 Drew et al. ..... 250/288
5,828,070 A * 10/1998 Brailove et al. ..... 250/443.1
6,670,623 B2 * 12/2003 Vella ..... 250/423 R
2006/0124849 A1 6/2006 Waki
2009/0242747 A1 10/2009 Guckenberger et al.
2010/0025576 A1 * 2/2010 Adams ..... 250/288

FOREIGN PATENT DOCUMENTS

JP 54109895 A 8/1979
JP 2009294086 A 12/2009

OTHER PUBLICATIONS

GB Search Report dated May 31, 2011.
GB Combined Search and Examination Report dated Mar. 2, 2012.
Examination Report dated Jul. 11, 2012.

* cited by examiner

*Primary Examiner* — Jack Berman

(57) ABSTRACT

A method of replacing an ion source in a mass spectrometer (MS) system is provided, where the ion source includes an ionization volume, at least one ionizing element and at least one focusing element, and where the mass MS system includes the ion source, a vacuum chamber that houses the ion source, and an interlock chamber. The method includes opening a valve between the interlock chamber and the vacuum chamber, moving the ion source into the interlock chamber through the opened valve and closing the valve, and removing the ion source from the interlock chamber. The ion source may further include means for plugging into a docking station in substantially one action, where the docking station provides sufficient electrical connection, upon plugging with the ion source, for operation of the ion source.

20 Claims, 16 Drawing Sheets

SYSTEM AND METHOD FOR REPLACING AN ION SOURCE IN A MASS SPECTROMETER

BACKGROUND

Generally, mass spectrometers measure ions created from samples, enabling identification and quantitation of the molecular contents of the samples. Mass spectrometers include an ion source for ionizing the samples for subsequent focusing, filtering, detection and analysis. The ion source includes, for example, an ion volume (i.e., a small section of the ion source in which ionization occurs), one or more ionizing elements (e.g., a structure that typically contains a filament wire, such as tungsten or rhenium, an electron reflector, contact pins and a support piece), and one or more ion focusing elements, such as electrostatic lenses. The interior surfaces of the ion volume and lenses become contaminated with use. Furthermore, the filament wire of the ionizing elements will break after many hours of use making the entire filament structure, i.e., the ionizing elements, the most common consumable in a mass spectrometer. Because sensitivity and performance of the mass spectrometer depend on cleanliness of the ion source, which includes the ion volume and any focusing elements, and a functional ionizing mechanism, i.e., an intact filament wire with solid electrical connections, the ion source must be cleaned (completely or in part) and the ionizing elements replaced in accordance with routine maintenance practices.

Conventionally, the replacement process is very time consuming, typically requiring a minimum of about four hours. The mass spectrometer must be shut down and slowly cooled and vented, which necessarily includes losing the operating vacuum. In addition, performance of the replacement ion source is improved if it is allowed to bake and equilibrate for eight or more hours (e.g., overnight). Most of the time required for the conventional ion source replacement process is incurred to accommodate cooling and venting the mass spectrometer, followed by heating and achieving acceptable levels of vacuum and background once the replacement ion source has been installed. The time required to actually exchange the contaminated ion source with a clean ion source, or replace a filament assembly (e.g., an ionizing element) is relatively short; that is, once the mass spectrometer has been cooled and vented to atmospheric pressure.

Conventionally, an ion volume can be removed from a mass spectrometer without shutting down and breaking vacuum (U.S. Patent Application Publication No. 2009/0242747). However, removing the ionizing elements, e.g., filament assembly, typically requires shutting down, due to the complexity of the structure and necessity for robust electrical connections.

BRIEF DESCRIPTION OF THE DRAWINGS

The illustrative embodiments are best understood from the following detailed description when read with the accompanying drawing figures. It is emphasized that the various features are not necessarily drawn to scale. In fact, the dimensions may be arbitrarily increased or decreased for clarity of discussion. Wherever applicable and practical, like reference numerals refer to like elements.

DETAILED DESCRIPTION

Figure 1A:
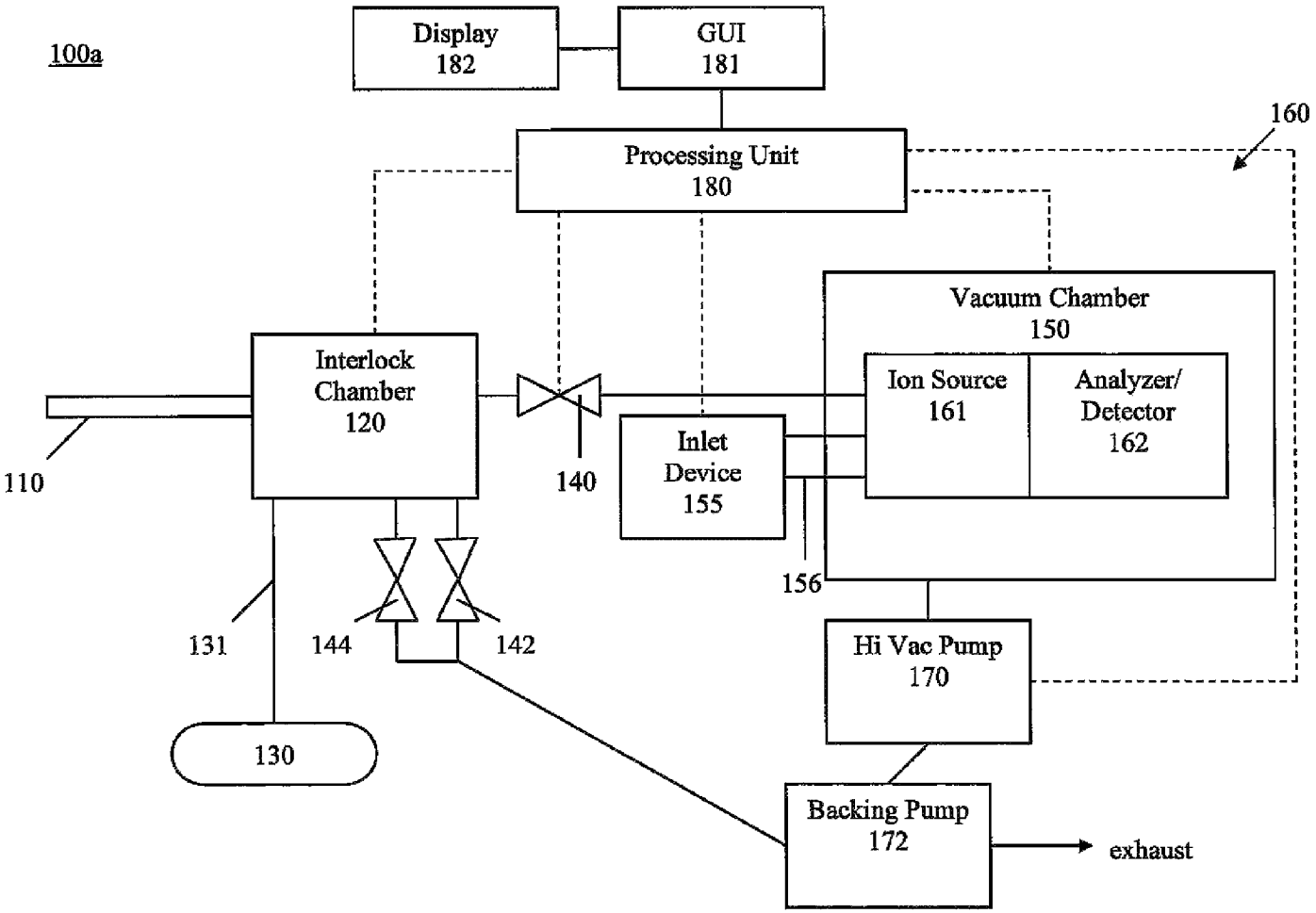
FIGS. 1A, 1B and 1C are block diagrams illustrating mass spectrometry systems including removable ion sources, according to representative embodiments.

Embodiments of the present invention provide methods to remove an entire ion source from a vacuum chamber without breaking the vacuum in the vacuum chamber, as well as ion sources that can be detached from an mass spectrometer system quickly. In various embodiments, the ion source is configured to plug into, or be unplugged from, a docking station in substantially one action. Thus, it is possible to remove the ion source without breaking a vacuum.

Embodiments of the present invention enable removal of not only the ion volume, but of the entire ion source, which includes the ion volume, the focusing elements, and the most consumable part, the ionizing elements, e.g., a filament assembly. Furthermore, the various embodiments shorten the time to achieve peak performance of an analysis once a clean and functional replacement ion source has been installed by providing a clean storage device for the replacement ion source, a method and hardware for purging contaminants from the vacuum interlock chamber, a method and hardware for quickly cooling the hot ion source once removed from the mass spectrometer, and a method and hardware for quickly heating the replacement ion source to above operating temperature in order to cleanse any contaminants. The ability to quickly heat the replacement ion source is addressed, for example, by including a heater/sensor assembly as part of the removable ion source. Furthermore, various embodiments provide a method of replacement that includes a high degree of automation in order to prevent equipment damage and to prevent harm to the user. Finally, should the cost of a full "ventless" system be prohibitive to some users, various embodiments also provide methods and apparatuses for replacing an entire ion source in a vented mode without the time, complexity, and risk of error involved in disconnecting and reconnecting a multitude of wires required by conventional methods and apparatuses. The ion source described in the various embodiments (which includes volume, lensing and ionizing elements) can be removed and installed without the need to remove any fasteners or wired connections, and a cap of a clean storage device may be used as a tool that eliminates the need for even clean gloves during removal or installation of a clean, fully functioning ion source.

In the following detailed description, for purposes of explanation and not limitation, illustrative embodiments disclosing specific details are set forth in order to provide a thorough understanding of embodiments according to the present teachings. However, it will be apparent to one having had the benefit of the present disclosure that other embodiments according to the present teachings that depart from the specific details disclosed herein remain within the scope of the appended claims. Moreover, descriptions of well-known devices and methods may be omitted so as not to obscure the description of the example embodiments. Such methods and devices are within the scope of the present teachings.

FIG. 1A is a functional block diagram illustrating a system having a replaceable ion source in a mass spectrometer, according to a representative embodiment.

Referring to FIG. 1A, mass spectrometry system 100*a* includes interlock chamber 120 connected to main vacuum chamber 150 of mass spectrometer (MS) 160 through valve 140. The MS 160 also includes removable ion source 161, analyzer/detector 162, a vacuum/pump system including high vacuum pump 170 and roughing or backing pump 172, and various electronics modules (not shown) and software (indicated by processing unit 180). An inlet device 155, such as a gas chromatograph (GC) device, provides samples to the ion source 161 though transfer line 156. The vacuum chamber 150 may be a vacuum manifold, for example, which contains the removable ion source 161 and the analyzer/detector 162 for identifying molecular contents of the various samples.

The vacuum chamber 150 is sealed to maintain the vacuum provided by the vacuum system. The high vacuum pump 170 may be a turbo molecular pump or an oil diffusion pump, and the backing pump 172 may be a rotary vane pump or diaphragm pump, for example. In the depicted embodiment, the backing pump 172 serves both for backing the high vacuum pump 170 and for the evacuation of the interlock chamber 120 using first and second valves 142 and 144, as discussed below.

In an embodiment, the valve 140 between the interlock chamber 120 and the vacuum chamber 150 is a gate valve. The gate valve 140 may be pneumatically operated, e.g., requiring 65-80 psi, through a pressurized line that is opened and closed via a solenoid valve, for example. Generally, gate valves are reliable, and include positive sealing and fault sensors, which may be used to detect when the valve 140 is not fully opened or not fully closed, as discussed below with reference to blocks 518 and 524 of FIG. 5 and blocks 918 and 926 of FIG. 9. For example, the valve 140 may only open or close partially if the supply line becomes depressurized. In addition, the fault sensors may detect fault states triggering processing unit 180 to disable introduction of purge and/or cooling gas into the interlock chamber 120, discussed below with reference to FIGS. 5 and 9. Of course, the valve 140 may be implemented as various other types of valves, such as a solenoid operable gate valve, a butterfly valve, a ball valve, plug valve, or the like, without departing from the scope of the present teachings.

In various embodiments, the analyzer/detector 162 may include one or more mass analyzers, a fragmentation device and a detector, for example. Generally, the ion source 161 receives samples, which include molecules to be identified, and ionizes the samples to provide ions to the mass analyzer/detector 162. The mass analyzer(s) may be any type or combination of types of mass analyzers, including quadrupole mass spectrum analyzers or time-of-flight (Q-TOF) mass spectrum analyzers, magnetic sector analyzers, or ion trap analyzers, for example.

The ion source 161 is removable from the vacuum chamber 150, while the operating temperature and the vacuum are maintained, by moving the ion source 161 into the interlock chamber 120 through the valve 140 by manipulating probe 110, optionally after purging and evacuating the interlock chamber 120 using a suitable purge gas, and cooling the ion source 161 inside the interlock chamber 120 using a suitable cooling gas. In order to be removable, the ion source 161 must be configured so that the electrical connections made with the various components of the ion source 161 are removably insertable in corresponding sockets of a docking station connected to an interface circuit (not shown in FIG. 1A) of the MS 160, discussed below with reference to FIG. 12. A replacement ion source 161 may be a new or cleaned ion source.

In the depicted embodiment, the purge gas and the cooling gas are the same (e.g., nitrogen gas), and are pumped into the interlock chamber 120 through gas inlet line 131 from gas source 130. In alternative embodiments, the purge gas may be provided from a purge gas source and the cooling gas may be provided from a separate cooling gas source through respective inlet valves, using the same or different gases, without departing from the scope of the present teachings.

The processing unit 180 is connected (shown by the dotted lines) to the various components, including the interlock chamber 120, the valve 140, the inlet device 155, the mass spectrometer electronics modules, the vacuum system (e.g., high vacuum pump 170 and backing pump 172), purge and cooling gas shutoff valve (not shown), the evacuation valves 142 and 144, the transfer line 156, auxiliary flow modules (not shown), and the like, in order to automate all or a portion of the ion source 161 replacement process and to provide fail safe features, discussed below. A user may interface with the processing unit 180 via graphical user interface 181, which enables use of a display 182 and interface means (not shown), such as a keyboard, a mouse, a joystick, thumbwheels, and the like. Embodiments of the processing unit 180 are discussed in more detail with reference to FIG. 10, below. Although depicted separately, it is understood that the processing unit 180 may be included within one or any combination of the MS 160 and the inlet device 155 in various embodiments.

In the depicted embodiment, the ion source 161 may be engaged by the probe 110, disconnected from the docking station and interface circuit of the MS 160 and slideably removed through the opened valve 140 into the interlock chamber 120. For example, the probe 110 may have a handle on a proximal end and an engaging mechanism, such as a spring loaded catch, a magnetic catch, a bayonet catch or other type of catch, on a distal end. Generally, the probe 110 may be inserted through the interlock chamber 120 and the valve 140 into the vacuum chamber 150, rotated or otherwise manipulated to attach to the ion source 161 using the engaging mechanism, and withdrawn through the valve 140 into the interlock chamber 120. In various embodiments, the probe 110 may be operated manually by a user or automatically by a controller (e.g., processing unit 180).

Figure 14A:
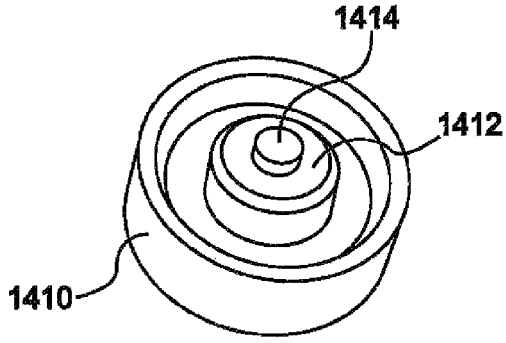
FIGS. 14A, 14B and 14C are perspective views of a protective container, modified cap and removable ion source, according to a representative embodiment.
Figure 14C:
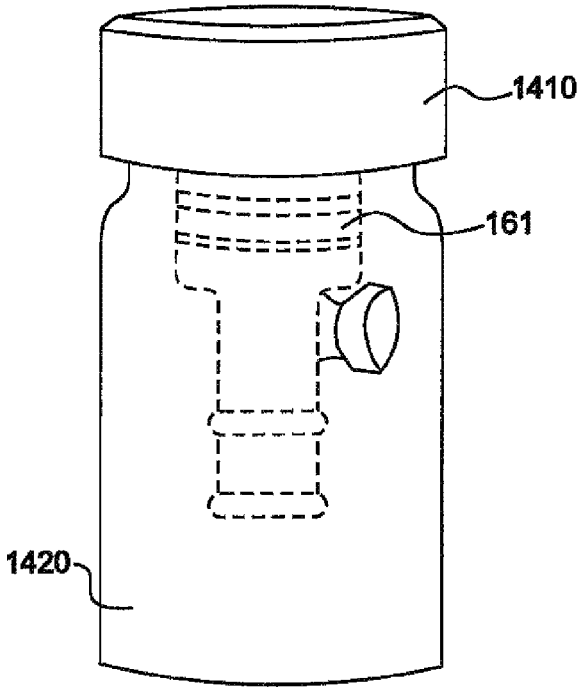
Figure 14B:
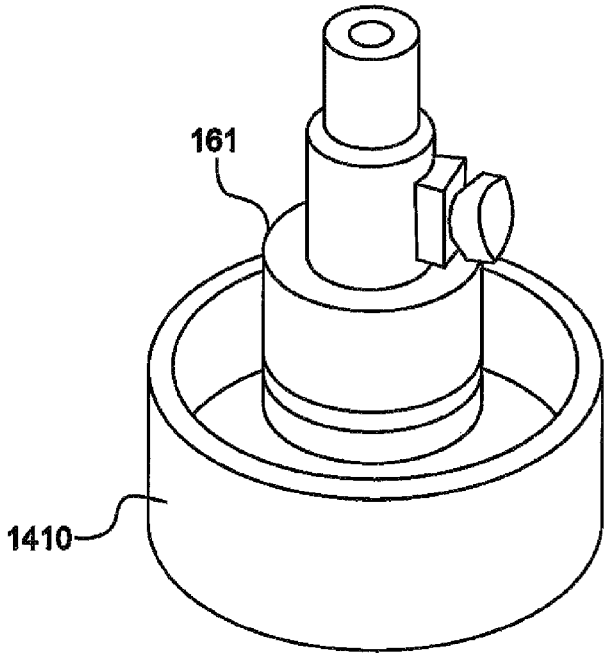

The ion source 161 includes at least an ion volume, one or more ionizing elements (e.g., filament assemblies), a series of lenses or focusing elements, and means to interface with the inlet device 155. In an embodiment, the ion source 161 further includes an internal heater and sensor for aiding in heating the replacement ion source 161 for a bake-out time period, discussed below with reference to block 928 of FIG. 9. An example of the ion source 161 is provided by FIG. 12, which depicts removable ion source 1260 and corresponding docking station 1280, according to a representative embodiment. In addition, the replacement ion source 161 may be stored, for example, in a bottle or container with a desiccant, and a cap configured to secure the ion source 161 using the same type connection as the probe 110, for example. FIGS. 14A through 14C show perspective views of a protective container, cap and removable ion source, according to a representative embodiment. The container and cap seals and suspends the replacement ion source 161 within the container, to maintain an ultraclean/dry state of the replacement ion source 161 until insertion.

The ionizing elements of the ion source 161 are consumable and thus have a finite life. Regular maintenance is typically performed to replace the ionizing elements, in an attempt to prevent the ionizing elements from failing during an analysis, causing unexpected downtime and loss of sample. Conventionally, the same lengthy service procedure is required to replace the ionizing elements as to clean the ion source 161. Although the ion source 161 may include two ionizing elements, a user may decide not to replace the first failed ionizing element immediately upon failure, due to this anticipated downtime. However, the removable ion source 161 according to various embodiments provides the ability for a clean ion source to be installed (or just one of the ionizing elements or other component to be replaced, for example) and be up and running at full sensitivity in a short period of time (e.g., about thirty to sixty minutes).

Depending on the mode of operation of the MS 160, electrons emitted from the filament of the ionizing elements of ion source 161 may both ionize and fragment the analyte, as in an electron impact (EI) mode of operation, for example. However, in a chemical ionization (CI) mode of operation, electrons emitted from the filament preferentially ionize molecules of a secondary reagent gas, such as methane, ammonia, isobutene or the like. The reagent gas ions subsequently ionize the analyte, creating both positive and negative analyte ions, depending on the nature of the analyte. Notably, the structure of the ion source 161 may vary slightly depending on whether it is an EI ion source or a CI ion source. For example, aperture sizes are smaller in a CI ion source, certain lens elements connected together in a CI ion source are separate in an EI ion source, the primary material used in an EI ion source (e.g., inconel) is different than the primary material used in a CI ion source (e.g., molybdenum), etc. However, because the basic structure is generally the same, the ion source 161 is removably insertable in the docking station (without venting the vacuum chamber 150), as discussed above, whether the ion source 161 is an EI ion source, a CI ion source, or another type of ion source having a compatible configuration. Thus, according to various embodiments, the ion source 161 may be exchanged for a new or clean ion source of the same type or of a different type, without departing from the scope of the present teachings.

The inlet device 155 may be any type of device configured to control inputting samples to the MS 160, such as a GC device or a direct insertion solids probe, for example. The vacuum chamber 150 includes a transfer line 156 for interfacing the ion source 161 with the inlet device 155. For example, when the inlet device 155 is a GC device, a GC column is inserted through the transfer line 156, configured to have a tip that physically inserts into a corresponding opening of the ion source 161. The transfer line 156 is secured (vacuum tight) to the vacuum chamber 150, and the GC column may slide through the transfer line 156 to engage the ion source 161 within the vacuum chamber 150. The GC column is secured (vacuum tight) to the GC end of transfer line 156.

Figure 1B:
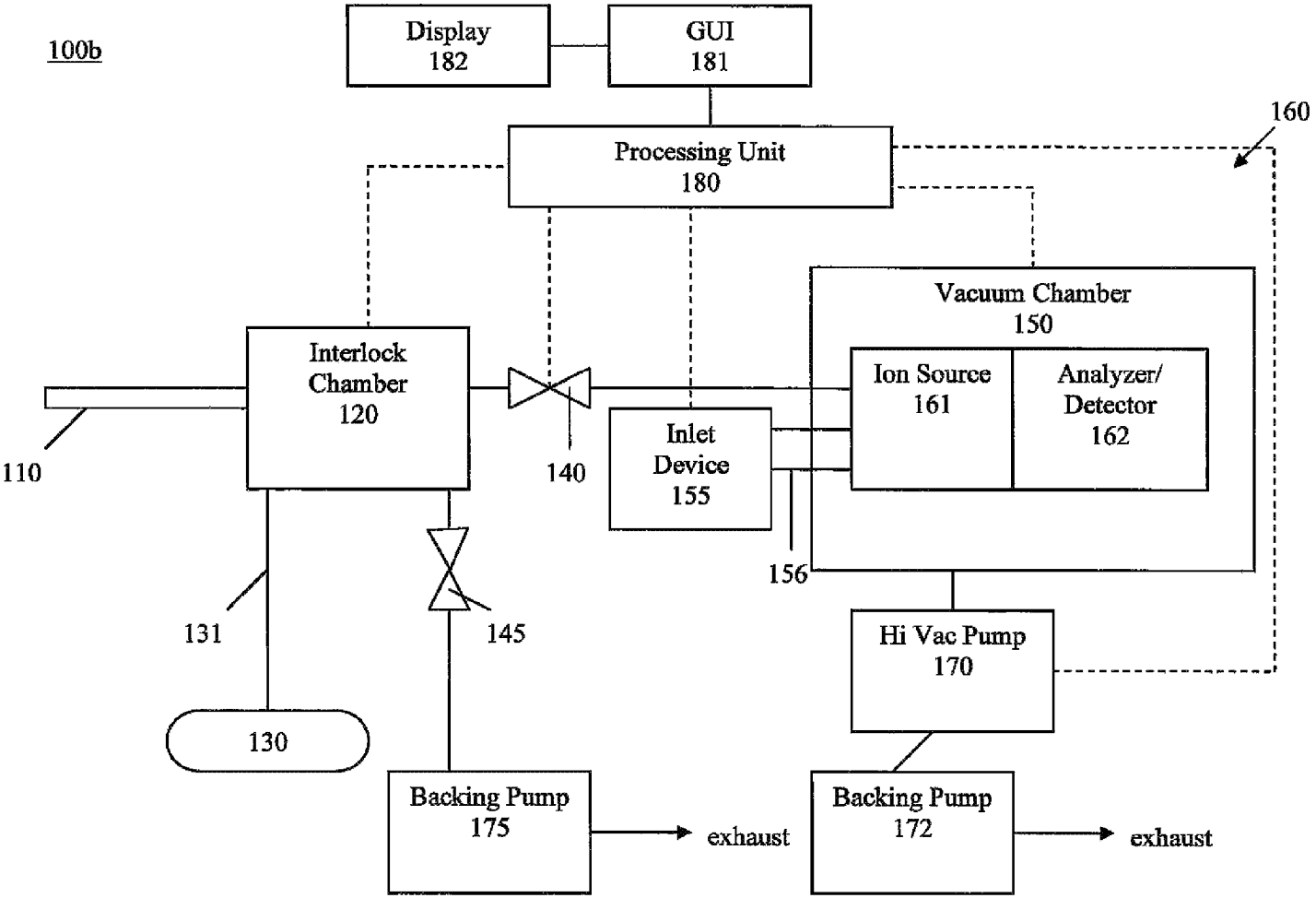

FIG. 1B is a functional block diagram illustrating a system having a replaceable ion source in a mass spectrometer, according to another representative embodiment.

FIG. 1B depicts mass spectrometry system 100*b*, which includes interlock chamber 120 connected to main vacuum chamber 150 of MS 160 through valve 140. The MS 160 also includes removable ion source 161, analyzer/detector 162, a vacuum/pump system including high vacuum pump 170 and roughing or backing pump 172, and various electronics modules (not shown) and software (indicated by processing unit 180). An inlet device 155, such as a GC device, for example, provides samples to the ion source 161 though transfer line 156. The vacuum chamber 150 may be a vacuum manifold, for example, which contains the removable ion source 161 and the analyzer/detector 162 for identifying and quantifying analyte samples.

The high vacuum pump 170 may be a turbo molecular pump or an oil diffusion pump, and the backing pump 172 may be a rotary vane pump or diaphragm pump, for example. However, unlike the mass spectrometer system 100*a* in FIG. 1A, the interlock chamber 120 of the mass spectrometer system 100*b* includes a separate, dedicated backing pump 175 for evacuating the interlock chamber 120 through valve 145, which may also be a rotary vane pump or diaphragm pump, for example. Use of the dedicated backing pump 175 increases efficiency of the evacuation operations of the interlock chamber 120, since the two valves 142 and 144 are replaced by a single valve 145, thus eliminating a step when pumping the interlock chamber 120. For example, not only is a step in the process eliminated, but the time required for evacuating the interlock chamber 120 is reduced because the single valve 145 may be a high conductance valve, since there is no danger of adversely affecting the performance of the high vacuum pump 170 during evacuation of the interlock chamber 120 when using the dedicated backing pump 175.

Figure 1C:
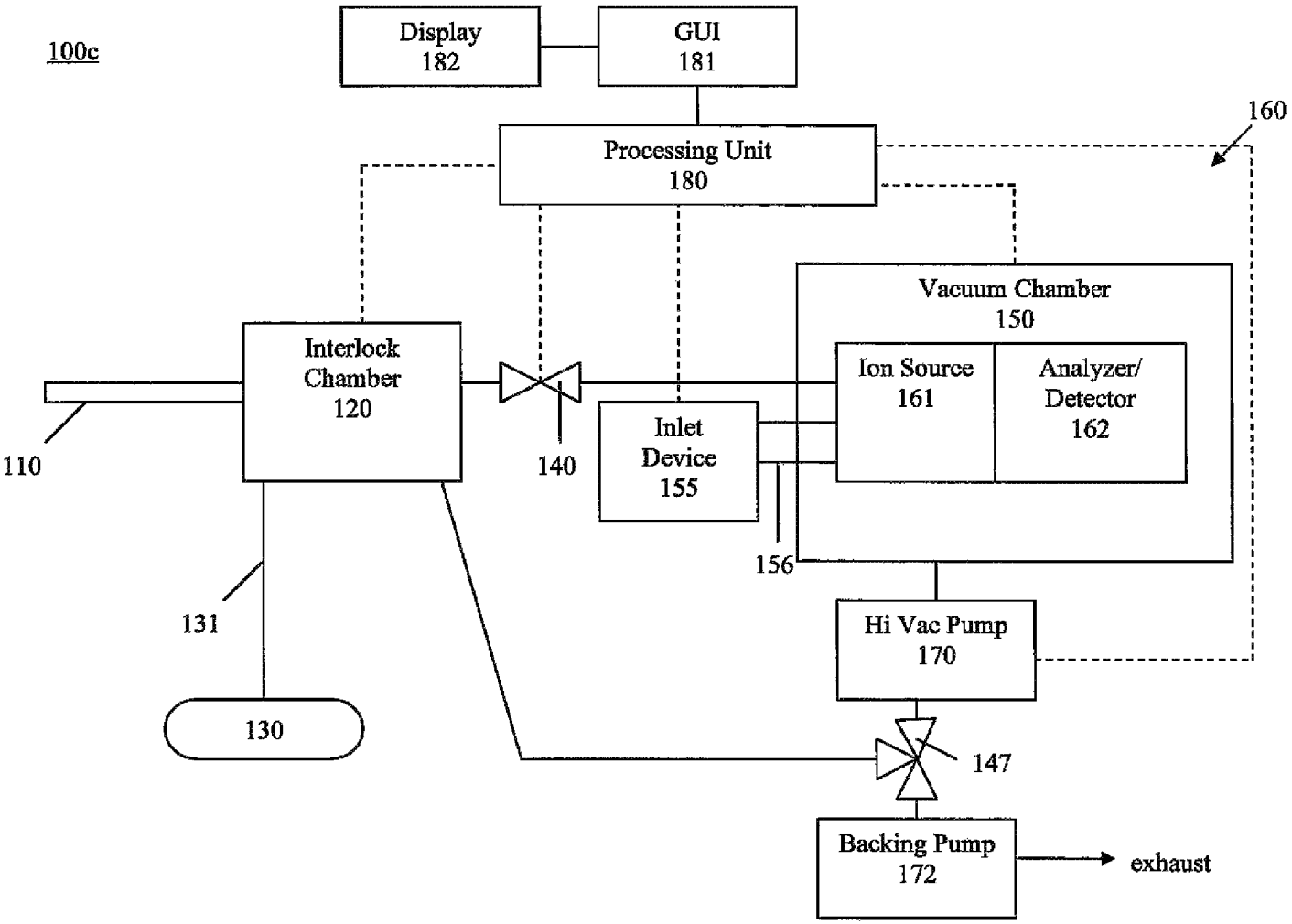

FIG. 1C is a functional block diagram illustrating a system having a replaceable ion source in a mass spectrometer, according to another representative embodiment.

FIG. 1C depicts mass spectrometry system 100*c*, which includes MS 160, interlock chamber 120 connected to main vacuum chamber 150 of the MS 160 through valve 140, and inlet device 155 for providing samples to a removable ion source 161 of the MS 160 though transfer line 156, as discussed above with reference to FIGS. 1A and 1B. The MS 160 includes a vacuum/pump system including high vacuum pump 170 and roughing or backing pump 172.

In the mass spectrometry system 100*c*, the two-way valves 142 and 144 depicted in FIG. 1A, for example, are replaced by one three-way valve 147 positioned between the backing pump 172 and the high vacuum pump 170. The valve 147 includes a normally closed port toward the interlock chamber 120 and a common port toward the backing pump 172. In this embodiment, the valve 147 is of high conductance, and thus does not limit the function necessary to back the high vacuum pump 170 during normal operation.

During evacuation of the interlock chamber 120, the three-way valve 147 is closed to the high vacuum pump 170, and opened to the interlock chamber 120 for a specified time. For example, during this first time the valve 147 is switched, the interlock chamber 120 quickly evacuates from atmosphere to just below about 1 torr before it is necessary to switch the valve 147 back to backing the high vacuum pump 170. The high vacuum pump 170 is able to tolerate a short period of sealed no backing, during which time the foreline pressure rises, without detrimentally affecting performance or reliability. When the foreline pressure reaches a predetermined level, e.g., monitored with a gauge (not shown), depending on the type and size of the high vacuum pump 170, it is necessary to restore the backing function of the backing pump 172.

Accordingly, FIG. 1C depicts a configuration in which the three-way valve 147 is opened and closed for short periods to alternately evacuate the interlock chamber 120, while at the same time maintaining normal operation of the high vacuum pump 170, until the interlock chamber 120 is evacuated to the level needed to open the valve 140. The valve 147 then stays open between backing pump 172 and high vacuum pump 170, which is the normal operating position of the valve 147. Unlike the mass spectrometer system 100*a* in FIG. 1A, there is no need to slowly evacuate the interlock chamber 120 through a low conductance path in order to protect the high vacuum pump 170, which is simultaneously open to the evacuation flow of the interlock chamber 120. On the contrary, because the valve 147 enables the high vacuum pump 170 to be completely isolated for periods of time, the interlock chamber 120 can be evacuated faster and more efficiently when using a single backing pump.

Figure 2:
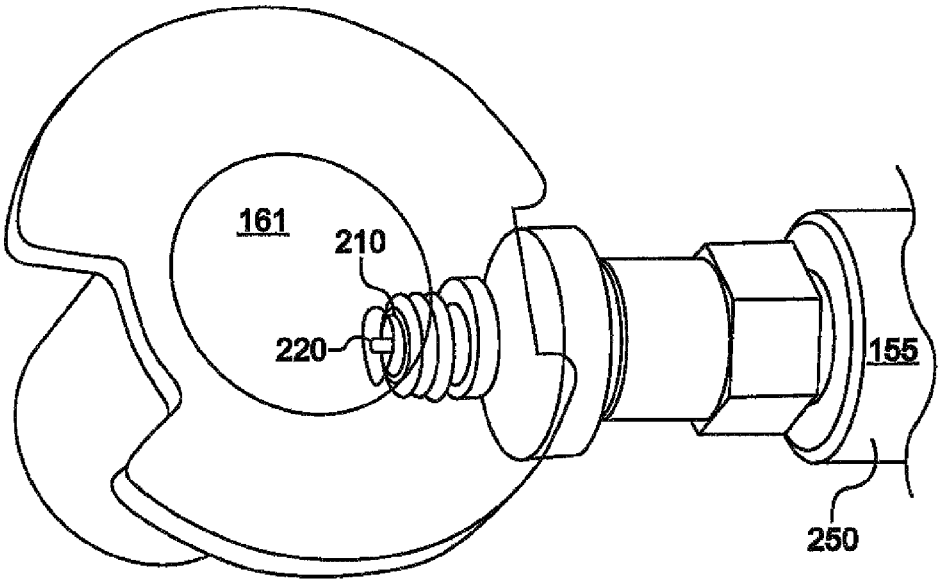
FIG. 2 is a perspective view of the removable ion source and retractable transfer tip, according to a representative embodiment.

FIG. 2 is a perspective view of a representative ion source 161 and a connecting portion of the transfer line 156. The ion source 161 includes aperture 210 configured to receive retractable transfer tip 220 of the transfer line 156 (which may be heated) for operationally connecting the ion source 161 and the inlet device 155. The transfer line 156 is connected to the side of the vacuum chamber 150 via flange 244 (shown in FIG. 3), maintaining the vacuum within the vacuum chamber 150, and the transfer tip 220 moves laterally as viewed in FIGS. 2 and 3 by means of bellows 230 (shown in FIG. 3). In an embodiment, the transfer tip 220 is extended into the aperture 210, for interfacing with the ion source 161, and retracted from the aperture 210, enabling removal of the ion source 161, using a manually activated lever. However, in alternative embodiments, the transfer tip 220 may be moved by various other means, such as electric motors, cams, pneumatic cylinders and the like, either manually or automatically by a controller (e.g., processing unit 180), without departing from the scope of the present teachings. For example, movement of the transfer tip 220 may be provided by an air cylinder (not shown) positioned parallel to the axis of motion of the transfer line 156, and a pressurized line controlled, for example, by a three-way solenoid valve. In a representative embodiment, the cylinder may be a single action, spring return cylinder, for example, actuated by the solenoid.

Figure 3:
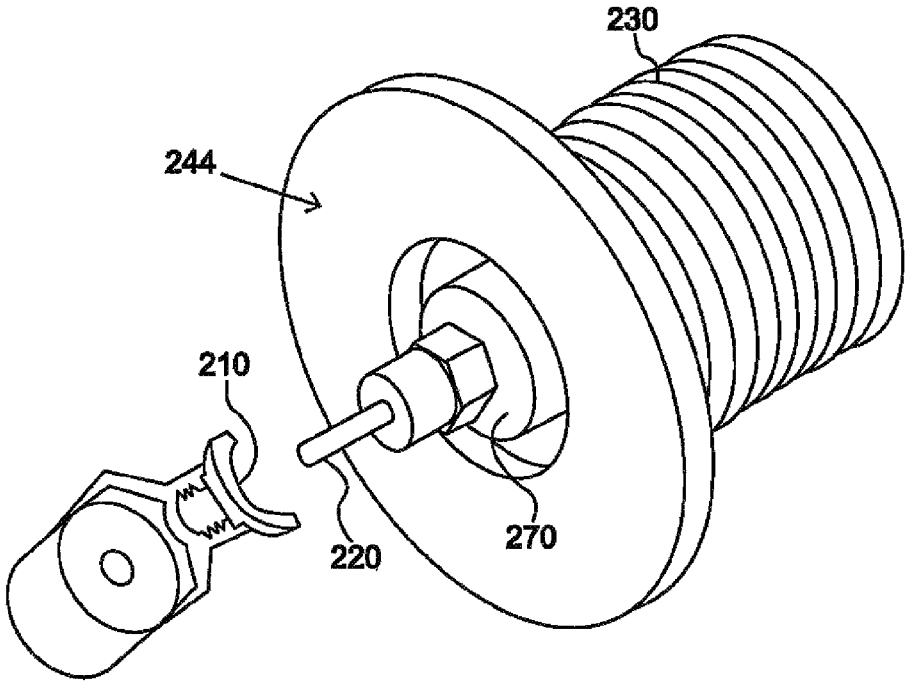
FIG. 3 is a perspective view of the removable ion source and retractable transfer tip, according to a representative embodiment.

FIG. 3 is a perspective view of the representative ion source 161 and connecting portion of the transfer line 156 in the "out" position, such that the transfer tip 220 is disengaged from the ion source 161. FIG. 3 includes a cross-sectioned portion of the ion source 161 and shows the aperture 210, which may include a substantially conical insert for guiding the extended transfer tip 220. The GC column is inside the transfer tip 220, which is contained in the bellows 230. As described above, the transfer tip 220 may be extended and retracted from the ion source 161 through the aperture 210. Of course, other means of retracting the transfer line 156 and/or transfer tip 220 may be incorporated without departing from the scope do the present teachings.

In addition to a clean ion source 161, sensitivity of the MS 160 also depends on the position of the retractable transfer tip 220 and the GC column relative to the inner diameter of the inside surface of the ion volume of the ion source 161, as well as pressure inside the ion volume of the ion source 161. Hence, the transfer tip 220 and the GC column pass through the short tubular aperture 210 of fixed conductance and terminate at an exact position within the ion source 161.

Figure 4:
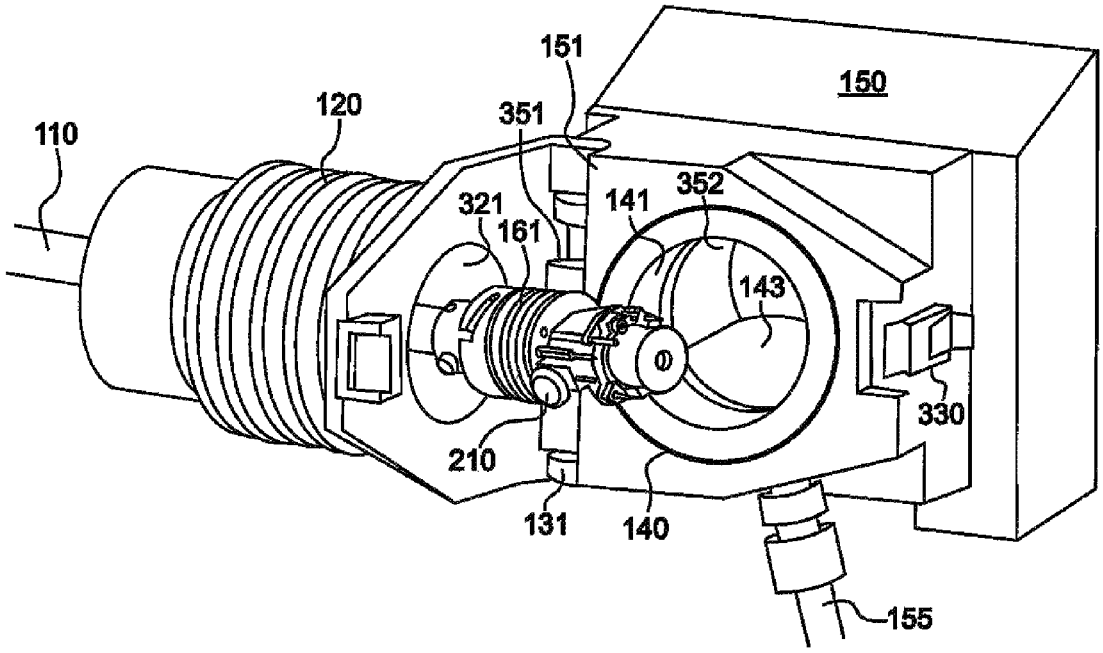
FIG. 4 is a perspective view of an interlock chamber and a vacuum chamber of the mass spectrometry system, according to a representative embodiment.

FIG. 4 is a perspective view of an interlock chamber and a vacuum chamber of the mass spectrometry system, according to a representative embodiment.

Referring to FIG. 4, the interlock chamber 120 is shown in an open position, connected to a front outer face of an extended portion 151 of the vacuum chamber 150 by a hinged portion 351. When in the closed position, the interlock chamber 120 and the vacuum chamber 150 form an air tight seal via the extended portion 151. In various embodiments, other means of connecting the interlock chamber 120 with the vacuum chamber 150 and/or the extended portion 151 may be incorporated without departing from the scope of the disclosure. The interlock chamber 120 includes an interior portion 321, which is shown as generally cylindrical in shape, although other shapes may be incorporated without departing from the scope of the present teachings. The ion source 161 is removed into the interior portion 321 during the removal process. The vacuum chamber 150 likewise includes an interior portion 352.

The interior portion 321 of the interlock chamber 120 and the interior portion 352 of the vacuum chamber 150 may be joined through operation of the valve 140, which is depicted in the representative embodiment as a pneumatic gate valve, although other types of valves may be incorporated in various embodiments. The valve 140 includes a valve opening 141 and a gate 143, which opens and closes by sliding across the valve opening 141. Operation of the gate 143 may be controlled, for example, by the processing unit 180. The gate 143 is shown in the partially open position for perspective. When the gate 143 is in the fully open position, the ion source can be removed from the vacuum chamber 150 into the interlock chamber 120 following purging and evacuation of the interlock chamber 120, discussed below.

The ion source 161 is shown in the removed position, where it is attached to a distal end of the probe 110. As depicted, the ion source 161 may be a contaminated ion source, or an ion source needing a new filament assembly or other part, that has just been removed from the vacuum chamber 150 into the interlock chamber 120, e.g., according to the process described with reference to FIG. 5 below, and then pushed forward out of the interlock chamber 120 after the interlock chamber 120 has been opened, enabling the user physically to disconnect the ion source 161 from the probe 110. Alternatively, the ion source 161 in FIG. 4 may be a clean or new replacement ion source that has just been attached to the probe 110 to enable insertion of the ion source 161 into the vacuum chamber 150, e.g., according to the process described with reference to FIG. 9 below. After the ion source 161 is drawn into the interlock chamber 161, it is then closed onto the vacuum chamber 150 for insertion of the ion source 161 through the valve 140. FIG. 4 clearly shows the aperture 210 of the ion source 161, which is configured to receive the retractable transfer tip 220, once the ion source 161 is positioned within the vacuum chamber 150.

Figure 5:
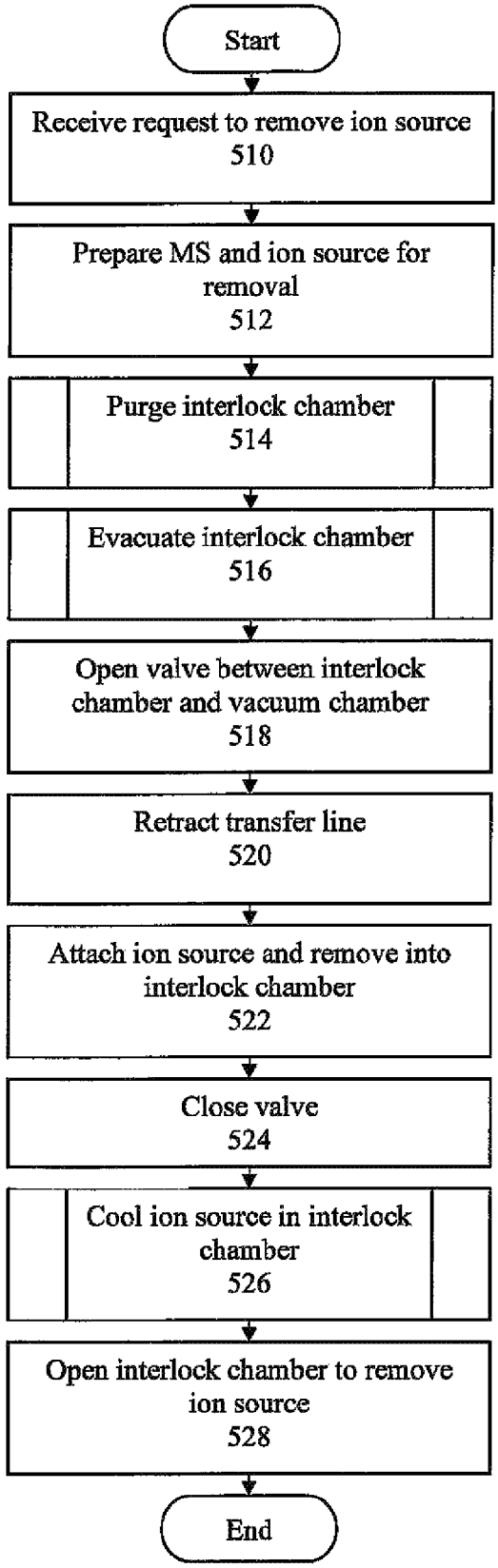
FIG. 5 is a flow diagram showing a method for removing an ion source from a mass spectrometer, according to a representative embodiment.

FIG. 5 is a flow diagram showing a method for removing an ion source from a mass spectrometer, according to a representative embodiment. In various embodiments, all or part of the method shown in FIG. 5 may be implemented automatically, under control of a software algorithm, e.g., executed by processing unit 180, without departing from the scope of the present teachings.

The process begins at block 510, in which a request is received to remove the ion source 161 from the MS 160. For example, the user may issue a command through GUI 181 informing the system 100 that the ion source 161 is to be removed. In an embodiment, the user may respond to a message, alert or other indication by the MS 160 that the ion source 161 needs to be replaced, for example, based on accumulated usage time or some measurement of the operational efficiency or operational state of the ion source 161. For example one or more ionizing elements of the ion source 161 (e.g., filament assemblies) could indicate a fault, or a recent tune file may be analyzed by the MS 160 and indicate that a cleaning would be beneficial In response, the ion source 161 and/or the MS 160 are prepared for removal of the ion source 161 in block 512. For example, the ion source thermal zone, the lenses and the ionizing elements of the ion source 161 may be turned off, and a quadrupole and/or other filtering devices of the analyzer/detector 162 may be set to a predetermined bake-out temperature (e.g., 200° C.). Also, the processing unit 180 may query the user to confirm that the interlock chamber 120 is closed or otherwise attached to the vacuum chamber 150 at the valve 140. In an embodiment, the processing unit 180 receives a signal from the interlock chamber 120 or a remote sensor (not shown) indicating when the interlock chamber 120 is closed and sealed. Then, if the processing unit 180 has not received such a signal, subsequent actions required for removing the ion source 161 will be blocked or disabled, and/or a fault is indicated, e.g., on the display 182.

Block 514 indicates a purge operation in which the interlock chamber 120 is purged using a purge gas supplied by gas source 130. The purpose of the purge operation is to remove moisture, air and contaminants from the interlock chamber 120 before opening the valve 140. This is because after the evacuation operation, described below, pressure inside the interlock chamber 120 may still be 10 to 1000 times greater than the pressure inside the vacuum chamber 150, in which the various elements of the MS 160, including the transfer line 156, remain hot. Accordingly, it is important to minimize the surge of oxygen, water, etc., whenever the gate 140 is opened to avoid damage to the ion source 161, the analyzer/detector 162, etc. As stated above, the purge operation may be entirely automated, e.g., under control of the processing unit 180, entirely manual, e.g., through manual manipulation valves and monitoring of pressure gauges, or some combination of both, without departing from the scope of the present teachings.

Figure 6:
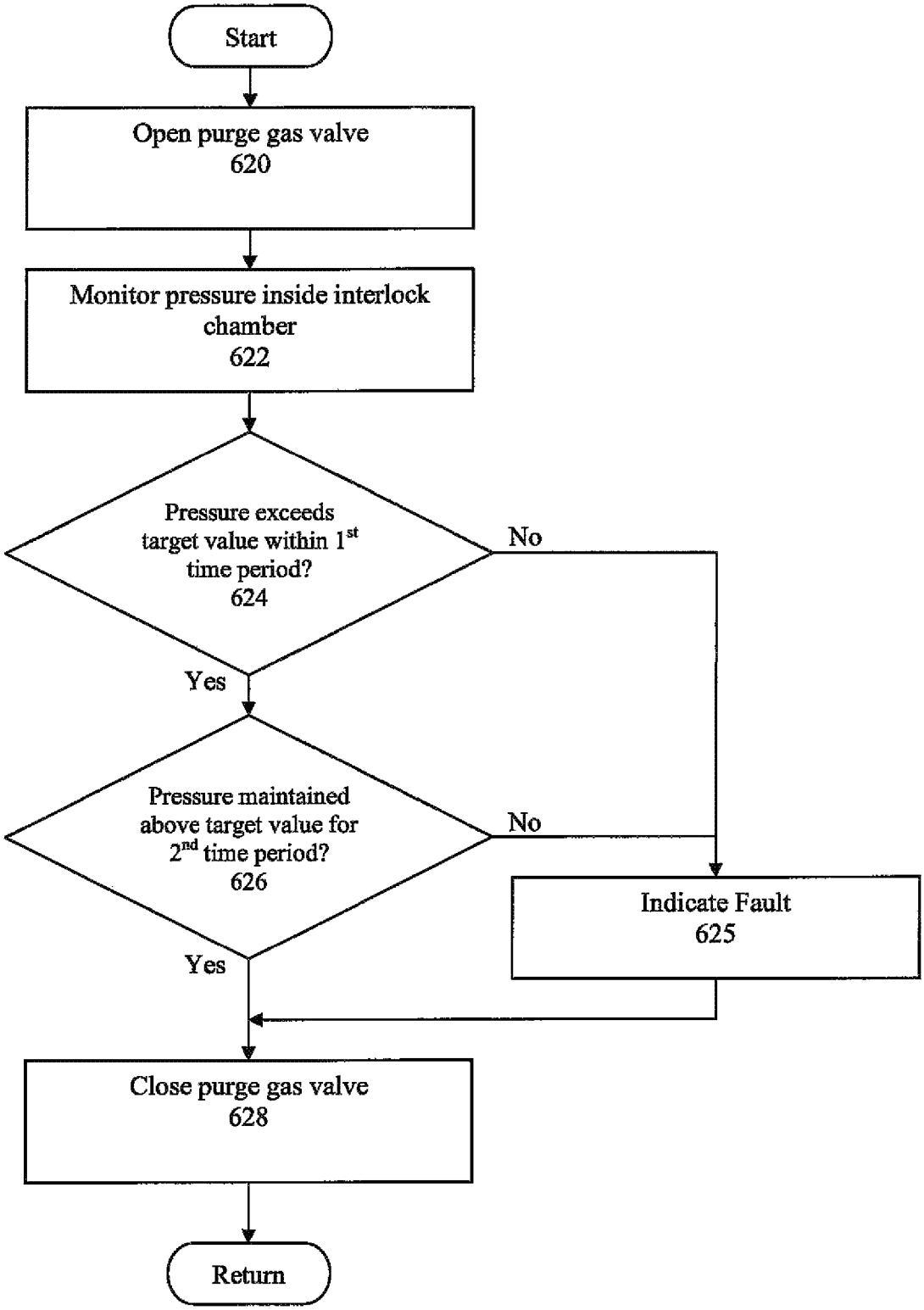
FIG. 6 is a flow diagram showing a method for purging an interlock chamber for replacing an ion source from a mass spectrometer, according to a representative embodiment.

An illustrative purge operation is depicted in FIG. 6, according to a representative embodiment. Referring to FIG. 6, a purge gas valve connecting the interlock chamber 120 and the gas source 130 is opened in block 620, allowing purge gas to enter the interlock chamber 120 via gas inlet line 131. The purge gas may be dry nitrogen gas, for example, although other gases or combination of gases may be used. In block 622, the pressure inside the interlock chamber is monitored using a pressure gauge (not shown), in order to ascertain the pressure inside the interlock chamber 161 relative to the time required for the pressure to attain various predetermined levels.

Based on the monitoring, it is determined in block 624 whether the pressure exceeds a predetermined target value within a predetermined first time period. For example, the purge gas valve may be opened for about 60 seconds, during which time it is determined whether the pressure inside the interlock chamber 120 exceeds the target value of about 760 torr within the predetermined first time period of about 5 seconds. If the pressure does not exceed the predetermined target value within the first time period (block 624: No), then a fault is indicated in block 625, e.g., on the display 182.

If the pressure does exceed the predetermined target value within the predetermined first time period (block 624: Yes), then it is determined in block 626 whether the pressure inside the interlock chamber 120 is maintained at the predetermined target value over a predetermined second time period. For example, it may be determined whether the pressure inside the interlock chamber 120 remains at (or near) the target value of about 760 torr for at least the predetermined second time period of about 60 seconds, or however long the purge gas valve remains open.

If the pressure is not maintained at the predetermined target value for the predetermined second time period (block 626: No), then a fault is indicated in block 625, e.g., on the display 182. If the pressure is maintained at or near the predetermined target value for the predetermined second time period (block 626: Yes), then the purge gas valve is closed in block 628, and the process returns to FIG. 5. As stated above, the opening and closing of the purge gas valve, as well as the monitoring of pressure and times, may be entirely automated, entirely manual, or some combination of both, without departing from the scope of the present teachings.

Referring again to FIG. 5, block 516 indicates an evacuation operation in which the interlock chamber 120 is evacuated of the purge gas, and the pressure inside the interlock chamber 120 is brought closer to the low pressure (e.g., the vacuum) inside the vacuum chamber 150, although the pressure in the interlock chamber 120 may still be 10 to 1000 times greater than that in the vacuum chamber 150. The valve 140 may then be opened in block 518, while substantially maintaining the low pressure (e.g., the vacuum) inside the vacuum chamber 150. Like the purge operation indicated by block 514, the evacuation operation indicated by block 516 may be entirely automated, e.g., under control of the processing unit 180, entirely manual, e.g., through manual manipulation valves and monitoring of pressure gauges, or some combination of both, without departing from the scope of the present teachings.

Figure 7A:
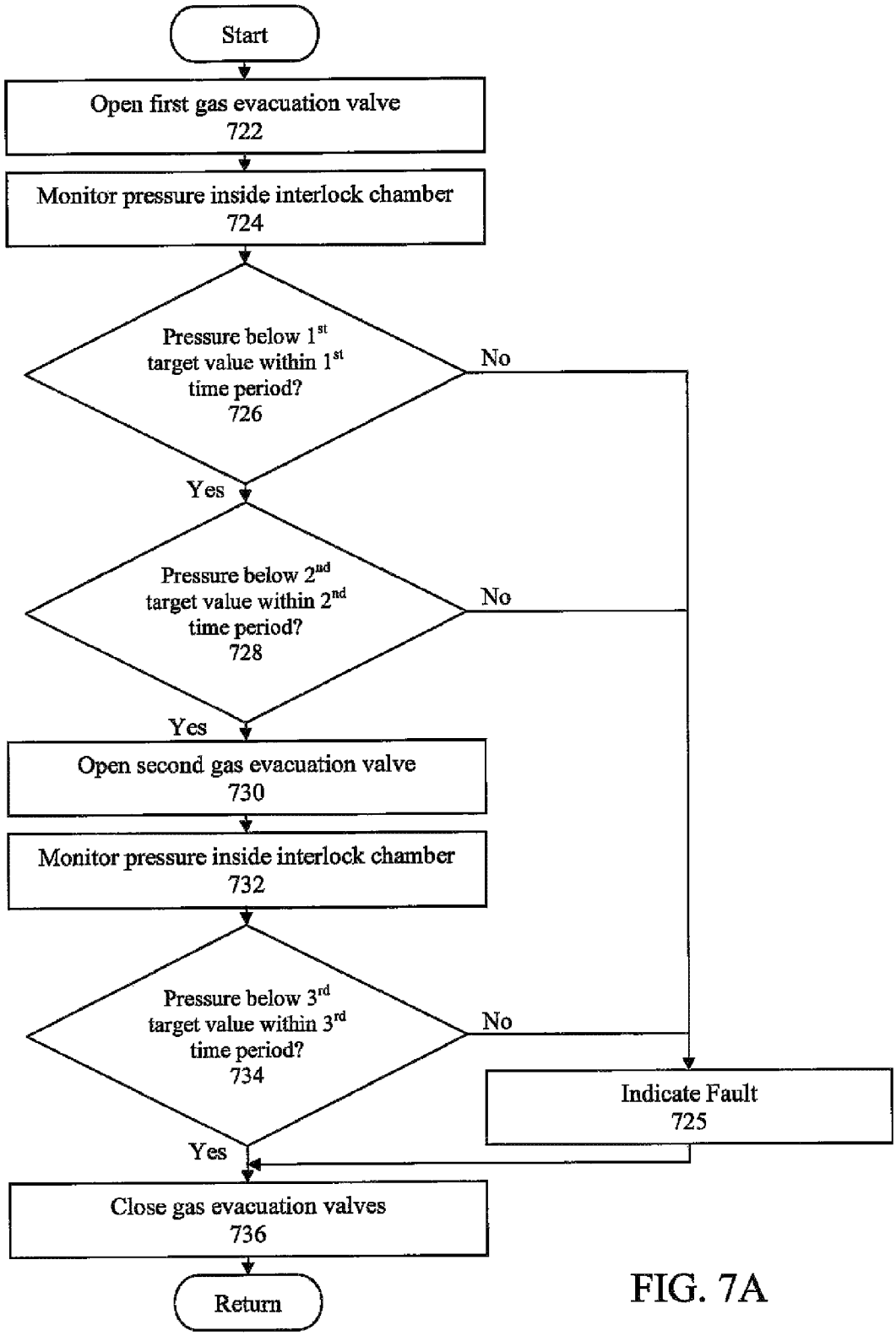
FIGS. 7A, 7B and 7C are flow diagrams showing methods for evacuating an interlock chamber for replacing an ion source from a mass spectrometer, according to representative embodiments.
Figure 7B:
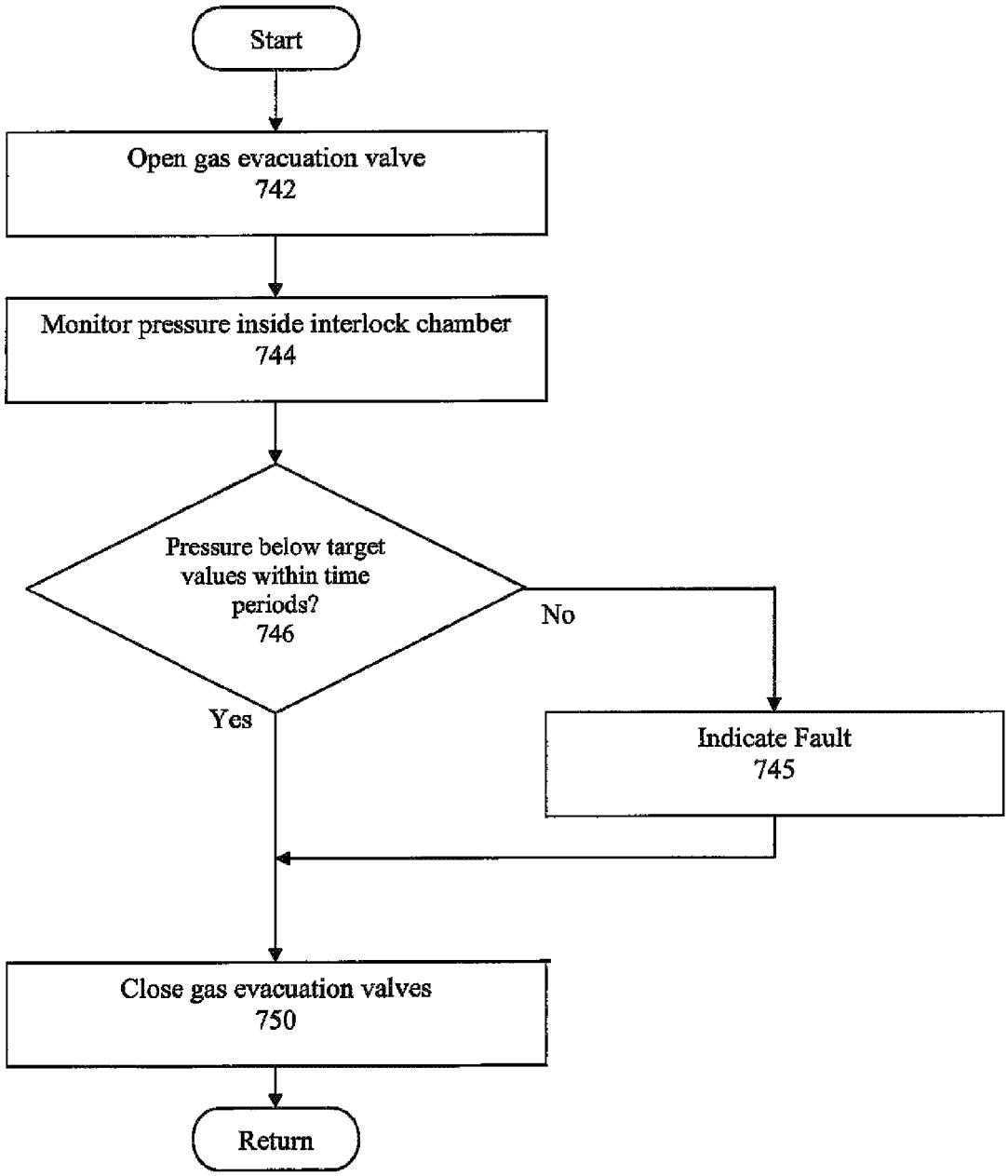
Figure 7C:
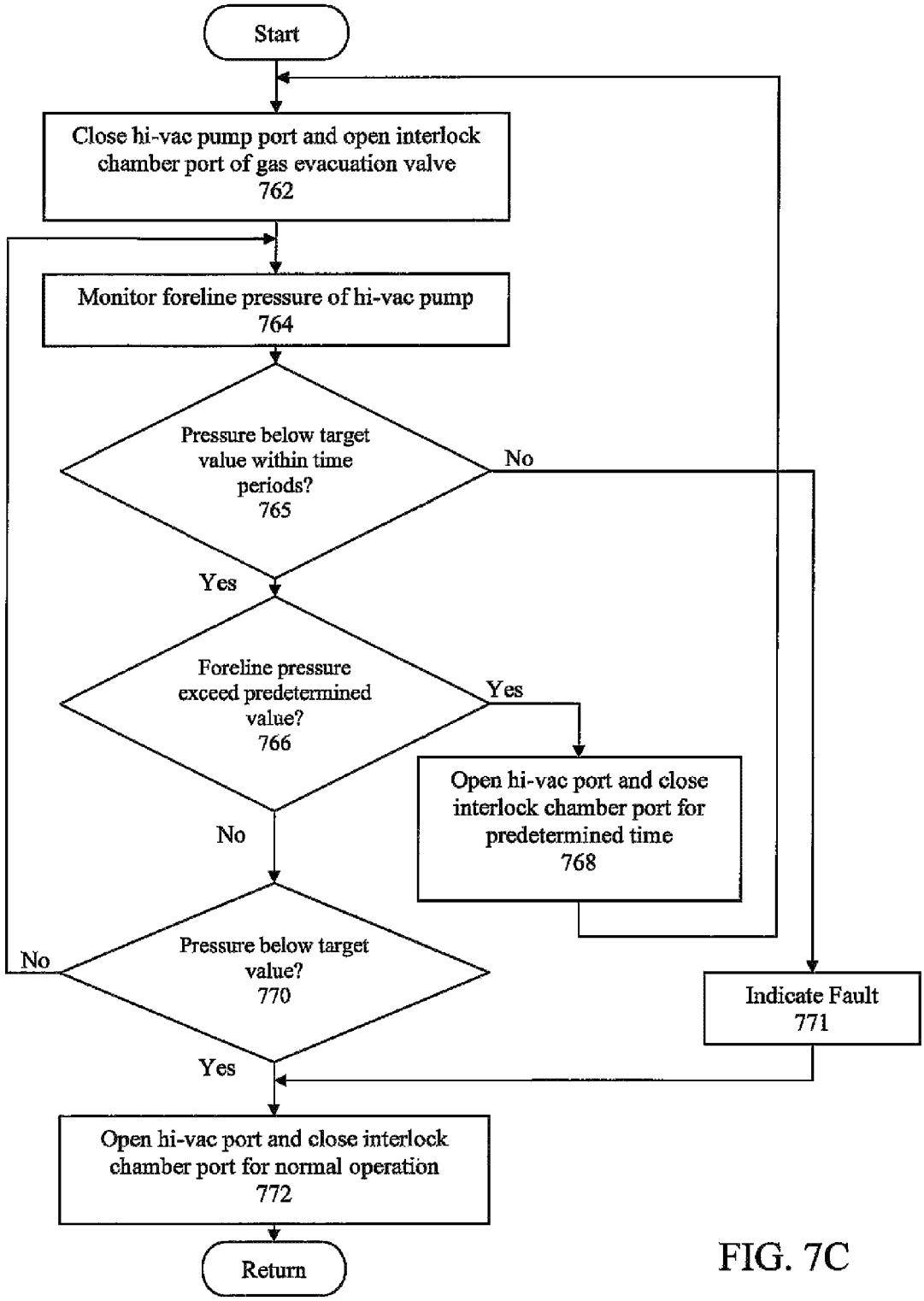

FIGS. 7A, 7B and 7C are flow diagrams showing alternative illustrative methods for evacuating the interlock chamber 120 to remove the ion source 161 from the vacuum chamber 150, according to representative embodiments. The representative methods depend on the configuration of the system 100. In particular, the method shown in FIG. 7A may be implemented when the system 100 includes a single backing pump, e.g., backing pump 172 as shown in FIG. 1A, for creating a low pressure in the interlock chamber 120 and for backing the high vacuum pump 170 of the vacuum chamber 150. When a single backing pump 172 is employed, the interlock chamber 120 has two gas evacuation valves, valve 142 having a restriction (e.g., a bleed valve) and valve 144, having no restriction. The method shown in FIG. 7B may be implemented when the system 100 includes multiple backing pumps, e.g., backing pumps 172 and 175 as shown in FIG. 1B, so that each of the interlock chamber 120 and the high vacuum pump 170 of the vacuum chamber 150 has a corresponding dedicated backing pump. When multiple pumps are employed, the interlock chamber 120 may have one gas evacuation valve 145, which does not have a restriction. The method shown in FIG. 7C may be implemented when the system 100 includes a single backing pump, e.g., backing pump 172 as shown in FIG. 1C, connected to the high vacuum pump 170 through three-way valve 147.

Referring to FIG. 7A, a first gas evacuation valve 142 of the interlock chamber 120 is opened in block 722, causing the purge gas to be pumped from the interlock chamber 120 by the backing pump 172, and output through a pump filter as exhaust. The first gas evacuation valve 142 may be a bleed valve, for example, having a restriction of about $10^{-3}$ l/s, which restricts the flow of purge gas exiting the interlock chamber 120. In block 724, the pressure inside the interlock chamber 120 is monitored using the pressure gauge (not shown), in order to determine when the pressure inside the interlock chamber 120 drops to predetermined target values.

Based on the monitoring, it is determined in block 726 whether the pressure drops below a predetermined first target value within a predetermined first time period. For example, the pressure in the interlock chamber 120 should drop below a pressure of about 760 torr within about 10 seconds. If the pressure does not drop below the predetermined first target value within the predetermined first time period (block 726: No), then a fault is indicated in block 725, e.g., on the display 182. If the pressure does drop below the predetermined target value within the predetermined first time period (block 726: Yes), then it is determined in block 728 whether the pressure then drops below a predetermined second target value within a predetermined second time period. For example, the pressure in the interlock chamber 120 should drop below a pressure of about 50 torr within about 5 minutes of opening the first gas evacuation valve. If the pressure does not drop below the predetermined second target value within the predetermined second time period (block 728: No), then a fault is indicated in block 725 e.g., on the display 182.

If the pressure does drop below the predetermined second value with the predetermined second time period (block 728: Yes), then a second gas evacuation valve 144 of the interlock chamber 120 is opened in block 730. In an embodiment, the opening of the second gas evacuation valve 144 may be triggered automatically when the pressure reaches the second target value. Also, in an embodiment, the second gas evacuation valve 144 may be opened in parallel with the first gas evacuation valve 142. The second gas evacuation valve 144 does not have a restriction, thus having a larger orifice (e.g., about 0.120 inch) than the first gas evacuation valve 142. This enables unobstructed flow of the purge gas, which is pumped from the interlock chamber 120 by the backing pump 172 and output as exhaust. In block 732, the pressure inside the interlock chamber 120 is monitored using the pressure gauge, in order to determine when the pressure inside the interlock chamber 120 drops to a predetermined level.

Based on the monitoring, it is determined in block 734 whether the pressure drops below a predetermined third target value within a predetermined third time period. For example, the pressure in the interlock chamber 120 should drop below a pressure of about 100 mtorr within about 5 minutes of opening the second gas evacuation valve 144. If the pressure does not drop below the predetermined third target value within the predetermined third time period (block 734: No), then a fault is indicated in block 725, e.g., on the display 182. If the pressure does drop below the predetermined third target value within the predetermined third time period (block 734: Yes), then the first and second gas evacuation valves 142 and 144 are closed in block 736, and the process returns to FIG. 5. As stated above, the opening and closing of the gas evacuation valves 142 and 144, as well as the monitoring of pressure and times, may be entirely automated, or some combination of both, without departing from the scope of the present teachings.

Also, as stated above, the evacuation of the interlock chamber 120 occurs in two steps in FIG. 7A to enable use of a single pump, e.g., backing pump 172, to back the high vacuum pump 170 for providing a vacuum in the vacuum chamber 150, as well as to evacuate the interlock chamber 120. The first gas evacuation valve 142, equipped with a restrictor, is opened between the backing pump 172 and the interlock chamber 120. The restriction prevents a large influx of purge gas (e.g., nitrogen) from traveling toward the high vacuum pump 170 and backward up into the vacuum chamber 150. Such a sudden rush of purge gas would cause the high vacuum pump 170 to turn off, potentially compromising its life. In addition, fluids from the backing pump 172 would be carried through the high vacuum pump 170 into the vacuum chamber 150, potentially contaminating sensitive elements of the MS 160. Furthermore, if the first and second gas evacuation valves 142 and 144 were to remain open while the valve 140 is open (e.g., in block 518 of FIG. 5), then the high vacuum pump 170 would be pulling against the backing pump 172, potentially causing contamination from the backing pump 172 to travel through the valve 140 into the vacuum chamber 150. However, once the interlock chamber 120 is evacuated to about 50 torr, then the subsequent gas flow through the second (non-restrictive) valve 144, bringing the pressure to about 100 mtorr, is too low to cause any adverse effects to either the high vacuum pump 170 or the MS 160.

FIG. 7B depicts a representative evacuation process when the interlock chamber 120 and the high vacuum pump 170 connected to the vacuum chamber 150 each have a dedicated backing pump, i.e., backing pumps 175 and 172, respectfully. This avoids the potential problems of using a single backing pump. Referring to FIG. 7B, a gas evacuation valve 145 of the interlock chamber 120 is opened in block 742, causing the purge gas to be pumped from the interlock chamber 120 by the backing pump 175 and output as exhaust. The gas evacuation valve 145 does not have a restriction, similar to the second gas evacuation valve 144 discussed above with reference to FIG. 7A.

In block 744, the pressure inside the interlock chamber 120 is monitored using the pressure gauge (not shown), in order to determine when the pressure inside the interlock chamber 120 drops to a predetermined level. Based on the monitoring, it is determined in block 746 whether the pressure drops below predetermined target values within predetermined time periods. For example, the pressure in the interlock chamber 120 should drop below a pressure of about 760 torr within about 5 seconds and a pressure of about 100 mtorr within about 5 minutes. If the pressure does not drop below the predetermined target values within the predetermined time periods (block 746: No), then a fault is indicated in block 745 e.g., on the display 182. If the pressure does drop below the predetermined target values within the predetermined time periods (block 746: Yes), then the gas evacuation valve is closed in block 750, and the process returns to FIG. 5. As stated above, the opening and closing of the evacuation gas valve 145, as well as the monitoring of pressure and times, may be manual, automated or some combination of both, without departing from the scope of the present teachings.

FIG. 7C depicts a representative evacuation process when the interlock chamber 120 and the high vacuum pump 170 are connected to the same backing pump, i.e., backing pump 172, through a three-way valve 147. As stated above, the valve 147 has three ports, a first port connecting with the foreline of the high vacuum pump 170, a second port connecting with the backing pump 172 and a third port connecting with the interlock chamber 120. In normal operation, the first and second ports are opened and the third port is closed.

Referring to FIG. 7C, the first port of the valve 147 to the high vacuum pump 170 is closed and the third port of the valve 147 to the interlock chamber 120 is opened in block 762, causing the purge gas to be pumped from the interlock chamber 120 by the backing pump 172 and output as exhaust. The second port of the valve 147 to the backing pump 172 remains open throughout the process. In an embodiment, the valve 142 does not have a restriction, similar to the second gas evacuation valve 144 discussed above with reference to FIG. 7A, thus the interlock chamber 120 is quickly evacuated to just below about 1 torr, for example.

In block 764, the foreline pressure of the high vacuum pump 170 is monitored. For example, the foreline pressure may be monitored in real time using a gauge (e.g., different from the gauge used to monitor the pressure of the interlock chamber 120). According to the monitoring, it is determined in block 765, in the depicted embodiment, whether the interlock pressure drops below predetermined target values within predetermined time periods, as discussed above with respect to FIG. 7B. For example, the pressure in the interlock chamber 120 should drop below a pressure of about 760 torr within about 5 seconds and a pressure of about 100 mtorr within about 5 minutes. Of course, the times during which the evacuation is paused, based on the foreline pressure determinations made in block 766, discussed below, must be factored into the predetermined time periods. If the pressure does not drop below the predetermined target values within the predetermined time periods (block 765: No), then a fault is indicated in block 771, e.g., on the display 182. If the pressure does drop below the predetermined target values within the predetermined time periods (block 765: Yes), the process continues to block 766. As stated above, the opening and closing of the evacuation gas valve 147, as well as the monitoring of foreline pressure, interlock chamber pressure and various times, may be manual, automated or some combination of both, without departing from the scope of the present teachings.

It is determined in block 766 whether the foreline pressure has increased to above a predetermined level. When the foreline pressure is determined not to exceed the predetermined level (block 766: No), it is determined whether the pressure in the interlock chamber 120 is below a predetermined target value at block 770. When the pressure in the interlock chamber 120 is not below the target value (block 770: No), the first port of the valve 147 to the high vacuum pump 170 remains closed and the third port of the valve 147 to the interlock chamber 120 remains open, allowing the evacuation of the interlock chamber 120 to continue, and the process returns to block 764. When the pressure in the interlock chamber 120 is below the target value (block 770: Yes), the first port of the valve 147 to the high vacuum pump 170 is opened and the third port of the valve 147 to the interlock chamber 120 is closed at block 772, thus discontinuing the evacuation, and the process returns to FIG. 5.

Referring again to block 766, when the pressure in the foreline of the high vacuum pump 170 is determined to exceed the predetermined target value (block 766: Yes), the first port of the valve 147 to the high vacuum pump 170 is opened and the third port of the valve 147 to the interlock chamber 120 is closed at block 768 for a predetermined period of time, temporarily pausing the evacuation of the interlock chamber 120. Accordingly, the high vacuum pump 170 is reconnected with the backing pump 172, enabling the high vacuum pump 170 and the backing pump 172 to reestablish the low pressure (e.g., vacuum) at the foreline of the high vacuum pump 170. The process then returns to block 762, where the first port of the valve 147 to the high vacuum pump 170 is closed and the third port of the valve 147 to the interlock chamber 120 is opened, allowing the evacuation to continue by reconnecting the interlock chamber 120 with the backing pump 172. In an alternative embodiment, the first port of the valve 147 to the high vacuum pump 170 may be opened and the third port of the valve 147 to the interlock chamber 120 may be closed for the time period (measured in real time) it actually takes for the low pressure to be reestablished at the foreline of the high vacuum pump 170. Also, in an alternative embodiment, comparison to a predetermined time period (as opposed to a predetermined foreline pressure value) may be made in block 766, allowing the first port of the valve 147 to the high vacuum pump 170 to be closed and the third port of the valve 147 to the interlock chamber 120 to be opened only for a short period of time during which the pressure at the foreline of the high vacuum pump 170 and consequently the pressure in the vacuum chamber 150 will not be significantly affected.

Referring again to FIG. 5, once the interlock chamber 120 has been purged and evacuated, the pressure inside the interlock chamber 120 is substantially closer to the pressure inside the vacuum chamber 150. Therefore, in block 518, the valve 140 between the interlock chamber 120 and the vacuum chamber 150 is opened. Due to the reduced pressure differential, the surge of gas from the interlock chamber 120 into the vacuum chamber 150 can be pumped away by the high vacuum pump 170 quickly, leaving the connected interlock chamber 120 and vacuum chamber 150 at the same high vacuum pressure at which the vacuum chamber 150 was before the valve 140 was opened. In an embodiment, the valve 140 is opened automatically under control of the processing unit 180, based on a signal indicating that the pressure inside the interlock chamber has dropped to the appropriate target valve. Further, in an embodiment, a check is automatically performed, e.g., by the processing unit 180, to confirm that the valve 140 is fully opened before attempting to remove the ion source 161 into the interlock chamber 120, discussed below with reference to block 522. When the valve 140 is not fully opened, a fault indication is provided.

The transfer line 156 connecting the inlet device 155 with the ion source 161 is retracted in block 520. In an embodiment, the axis along which the ion source 161 is removed may be substantially orthogonal to (or otherwise intersect) the axis of the transfer line 156, thus requiring the transfer line 156 to be retracted temporarily in order to remove the ion source 161. In an embodiment, the transfer line is retracted automatically under control of the processing unit 180, using an air cylinder activated by opening a 3-way solenoid valve, a servo motor, or the like. Alternatively, the transfer line 156 may be retracted manually using a lever (not shown), or other device, such as a wheel, button or the like, configured to activate bellows (e.g., bellows 230 of FIG. 3) to withdraw the transfer tip 220 of the transfer line 156 from the ion source 161. Alternatively, the transfer line 156 may be configured to retract using some other method of retraction besides a bellows (such as sliding seals, for example), without departing from the scope of the present teachings.

In block 522, the ion source 161 is physically moved from the vacuum chamber 150 into the interlock chamber 120 through the open valve 140, while the pressure and temperature inside the vacuum chamber 150 is substantially preserved (i.e., the vacuum in the vacuum chamber 150 is preserved and all components of MS 160 remain at operating temperatures). In an embodiment, the ion source 161 is moved into the interlock chamber 120 manually, using the probe 110. As discussed above, for example, the probe 110 may be inserted through the interlock chamber 120 and the valve 140 into the vacuum chamber 150, rotated to attach to the ion source 161 on a bayonet catch or other connection mechanism, and withdrawn through the valve 140 and into the interlock chamber 120. In various embodiments, the probe 110 may be automated under control of the processing unit 180. Once the ion source 161 is removed into the interlock chamber 120, the valve 140 is closed in block 524. In an embodiment, the user responds to a software prompt from the processing unit 180 to close the valve 140 in block 524. The same prompt may trigger a software controlled cooling sequence, discussed below with reference to block 526.

Figure 8:
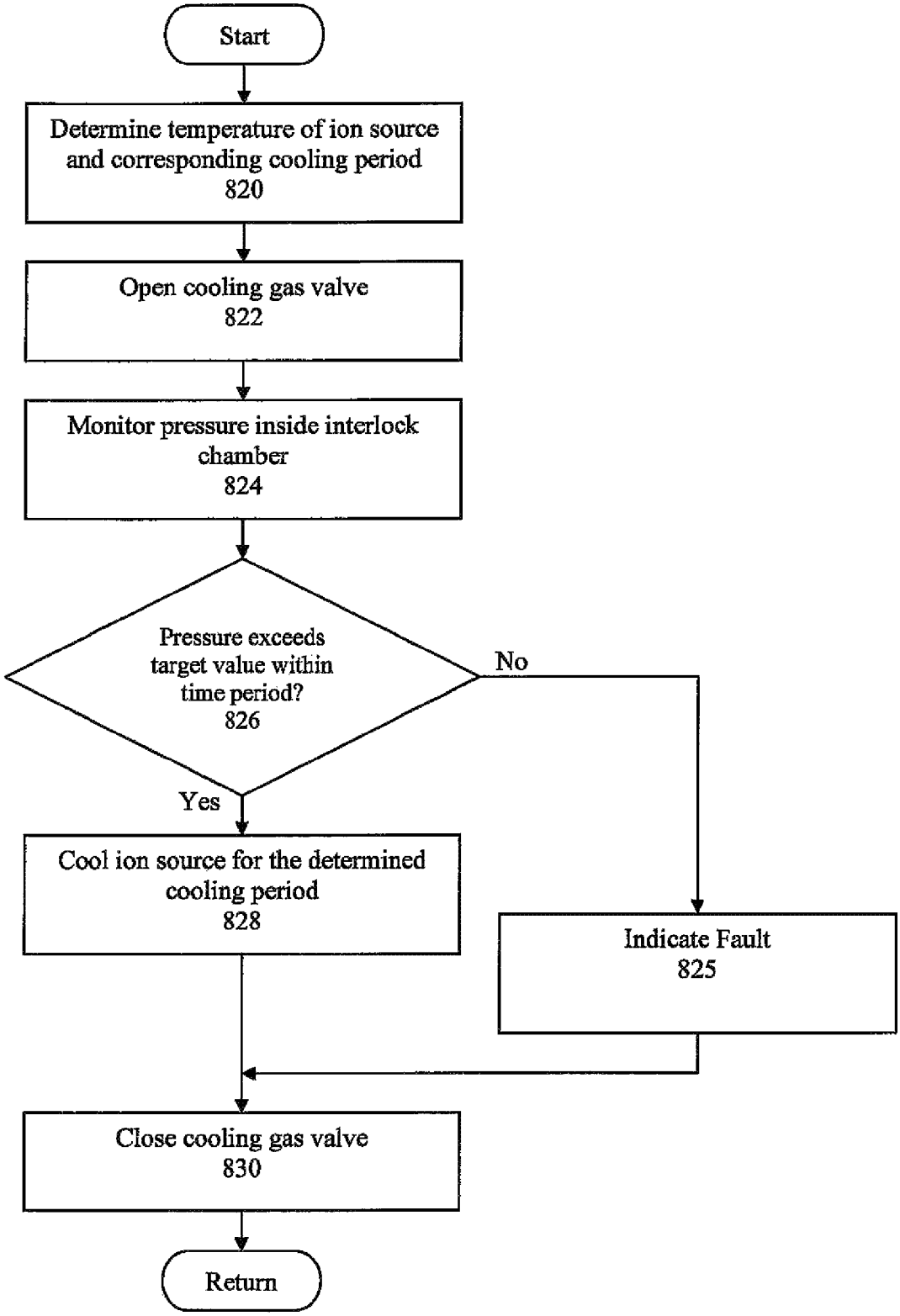
FIG. 8 is a flow diagram showing a method for cooling an ion source, according to another representative embodiment.

Block 526 indicates an operation in which the ion source 161 is cooled in the interlock chamber 120 using a cooling gas. An illustrative cooling operation is depicted in FIG. 8, according to a representative embodiment. Referring to FIG. 8, the temperature of the ion source 161 and a corresponding cooling period are determined in block 820. For example, the temperature of the ion source 161 may be measured and the corresponding cooling period may be determined by the processing unit 180 based on the measured temperature. Alternatively, the temperature and/or the appropriate cooling period of the ion source 161 may be estimated based on known operating characteristics of the MS 160 and/or the ion source 161.

In block 822, a cooling gas valve (which may be the same as the purge gas valve) connecting the interlock chamber 120 and the gas source 130 is opened, allowing cooling gas to enter the interlock chamber 120 via gas inlet line 131. In block 824, the pressure inside the interlock chamber 120 is monitored using the pressure gauge (not shown), in order to determine when the pressure inside the interlock chamber 120 exceeds a predetermined level. Based on the monitoring, it is determined in block 826 whether the pressure exceeds a predetermined target value within a predetermined time period. For example, the pressure in the interlock chamber 120 should exceed a pressure of about 760 torr within about 10 seconds. If the pressure does not exceed the predetermined target value within the predetermined time period (block 826: No), then a fault is indicated in block 845, e.g., on the display 182.

If the pressure does exceed the predetermined target value within the predetermined time period (block 826: Yes), then the ion source 161 is allowed to cool in the interlock chamber 120 for a cooling period in block 828. For example, if it is determined in block 820 that the temperature of the ion source 161 in the MS 160 was about 230° C., then the cooling period is determined to be about 10 minutes, during which the ion source 161 remains in the interlock chamber 120. As stated above, the cooling period corresponding to the temperature may be determined by the processing unit 180, for example, by accessing a previously populated database relating cooling periods and temperatures. In an alternative embodiment, the temperature of the ion source 161 may be monitored in real time within the interlock chamber 120, so that it is known when the ion source 161 is actually cooled to a desired temperature (e.g., 100° C.).

Once the ion source 161 has been cooled, the cooling gas valve is closed in block 830, and the process returns to FIG. 5. As stated above, the opening and closing of the cooling gas valves, as well as the monitoring of pressure and times, may be entirely automated, or some combination of both, without departing from the scope of the present teachings.

Referring again to FIG. 5, once the ion source 161 has been cooled in the interlock chamber 120, the pressure inside the interlock chamber 120 is substantially the same as the ambient pressure. Therefore, in block 528, the interlock chamber 120 may be opened, enabling removal of the ion source 161. For example, in the embodiment shown in FIGS. 3 and 4, the interlock chamber 120 is opened by pivoting to an open position on hinge member 351. The ion source 161, which is still attached to the end of the probe 110, may then be pushed outside the opened interlock chamber 120, as shown in FIG. 4, for example, where it can be manually removed from the probe 110.

In an embodiment, the processing unit 180 notifies the user when it is safe to open the interlock chamber 120, for example, based on the temperature and/or time spent cooling and/or pressure inside the interlock chamber 120. Also, the interlock chamber 120 may include a locking mechanism controllable by the processing unit 180 to prevent the user from opening the interlock chamber 120 early, which may cause oxidation of surfaces of the hot ion source 161 and/or harm to the user.

In an embodiment, a check is automatically performed, e.g., by the processing unit 180, to confirm that the valve 140 is fully closed, following block 524 of FIG. 5, before the the cooling gas is allowed to flow into the interlock chamber. When the valve 140 is not fully closed and/or the closed status of the valve 140 cannot be verified, a fault indication is provided and the interlock chamber 120 is locked in place. In an embodiment, the interlock chamber 120 may be locked in place using a software lock. Notably, though, in the depicted configuration, it would not be possible to open the interlock chamber 120 if the valve 140 is not fully closed, since the vacuum in the vacuum chamber 150 would securely hold the interlock chamber 120 in place.

Figure 9:
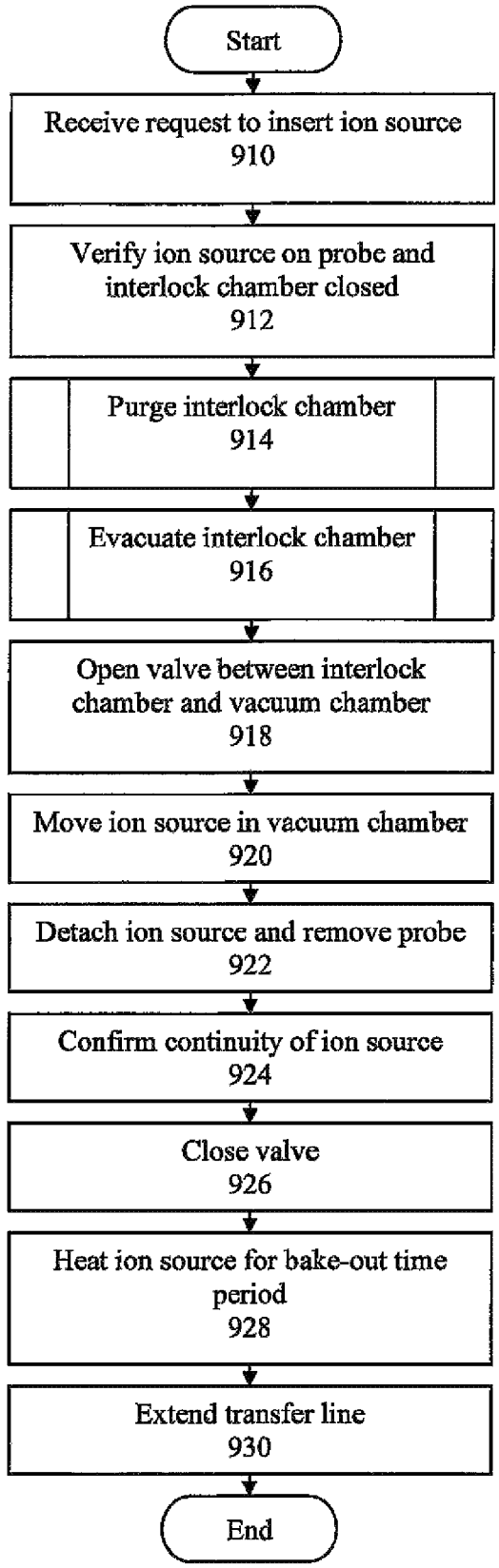
FIG. 9 is a flow diagram showing a method for replacing an ion source into a mass spectrometer, according to a representative embodiment.

After the ion source 161 is removed, a new or clean ion source (also referred to as ion source 161) is attached to the end of the probe 110. FIG. 9 is a flow diagram showing a method for replacing the ion source 161 into the MS 160, according to a representative embodiment.

Referring to FIG. 9, a request is received, e.g., by the processing unit 180, to replace the ion source 161 in block 910. For example, the user may issue a command through GUI 181 informing the system 100 that the new ion source 161 is to be inserted into the MS 160. In response, it is verified that the ion source 161 is attached to the end of the probe 110 and that the interlock chamber 120 has been closed in block 912. For example, the processing unit 180 may query the user via the GUI 181 and display 182 accordingly, and await a response entered by the user confirming the same. In an alternative embodiment, the processing unit 180 may receive electronic signals from remote sensors the interlock chamber 120, the probe 110 and/or remote sensors (not shown) automatically indicating the status of the ion source 161 and that the interlock chamber 120 is closed and sealed and/or that the ion source 161 is attached and the interlock Also, the processing unit 180 may query the user to confirm that the interlock chamber 120 is closed or otherwise attached to the vacuum chamber 150 at the valve 140. If the processing unit 180 has not received such signals, subsequent actions required for insertion of the ion source 161 will be blocked or disabled, and/or a fault is indicated, e.g., on the display 182.

Blocks 914 and 916 indicate purge operation and evacuation operations, respectively. In the purge operation of block 914, the interlock chamber 120 is purged using a purge gas supplied by gas source 130, as discussed above with reference to FIG. 6. The purpose of the purge operation is to remove moisture, air and contaminants from the interlock chamber 120. The purge operation may be entirely automated, e.g., under control of the processing unit 180, entirely manual, e.g., through manual manipulation valves and monitoring of pressure gauges, or some combination of both, without departing from the scope of the present teachings. In the evacuation operation of block 916, the interlock chamber 120 is evacuated of the purge gas, so that the pressure inside the interlock chamber 120 is closer to the pressure within the vacuum chamber 150, as discussed above with reference to FIGS. 7A, 7B and 7C. The valve 140 may then be opened in block 918, while maintaining the low pressure inside the vacuum chamber 150. The evacuation operation and the opening of the valve 140 may be entirely automated, e.g., under control of the processing unit 180, entirely manual, e.g., through manual manipulation valves and monitoring of pressure gauges, or some combination of both, without departing from the scope of the present teachings.

In various embodiments, the purge operation of block 914 may be performed in substantially the same manner as the purge operation described with reference to block 514 of FIG. 5 and FIG. 6, and the evacuation operation of block 916 may be performed in substantially the same manner as the evacuation operations described with reference to block 526 of FIG. 5 and FIGS. 7A, 7B and 7C. Therefore, these descriptions will not be repeated with respect to FIG. 9.

Following the evacuation operation, the pressure inside the interlock chamber 120 is substantially lower, for example, below a coded or manually observed set point pressure, such that it is safe to open the valve 140 while a vacuum is maintained in the vacuum chamber 150. The valve 140 may then be opened in block 918, while maintaining the low pressure inside the vacuum chamber 150. In other words, the purge gas is evacuated so that the interlock chamber 120 and the vacuum chamber 150 will equilibrate to the same high vacuum pressure under the pumping of the high vacuum pump 170 and its backing pump 172 once the valve 140 is opened. As discussed above with reference to blocks 736 and 750 of FIGS. 7A and 7B, respectively, the gas evacuation valves 142, 144 and 145 must be closed before the valve 140 is opened, which prevents the high vacuum pump 170 from pumping against the backing pump 172 or 175. Likewise, as discussed above with reference to block 772 of FIG. 7C, the 3-way gas evacuation valve 147 must be closed between the backing pump 172 and the interlock chamber 120 before the valve 140 is opened, which prevents the high vacuum pump 170 from pumping against the backing pump 172. In an embodiment, the valve 140 is opened automatically under control of the processing unit 180, based on a signal indicating that the pressure inside the interlock chamber has fallen below the appropriate target value valve. Further, in an embodiment, a check is automatically performed, e.g., by the processing unit 180, to confirm that the valve 140 is fully opened before attempting to move the ion source 161 into the vacuum chamber 150, discussed below with reference to block 920. When the valve 140 is not fully opened, a fault indication is provided.

In block 920, the ion source 161 is physically moved from the interlock chamber 120 into the vacuum chamber 150 through the open valve 140, while the pressure inside the vacuum chamber 150 remains substantially the same (i.e., the vacuum in the vacuum chamber 150 is preserved). The ion source 161 may be moved into the vacuum chamber 150 manually, using the probe 110. In an embodiment, the probe 110 is substantially self-aligning, allowing the vacuum in the vacuum chamber 150 to pull the probe 110 and the ion source 161 into engagement. The user may manually push the ion source 161 a short distance to assure the ion source 161 is secure in its electrical contacts within the MS 160. Also, in an embodiment, the probe 110 is configured so that the ion source 161 floats on the distal end with high degrees of translational and rotational freedom. This enables the electrical contact pins of the ion source 161, for example, to properly self-align with the corresponding sockets of the docking station.

Once positioned inside the vacuum chamber 150, the ion source 161 is detached from the probe 110 and the probe 110 is removed into the interlock chamber 120 in block 922. In various embodiments, operation of the probe 110 may be automated under control of the processing unit 180.

Once the ion source 161 is inserted into the vacuum chamber 150, the continuity of the ion source 161 is confirmed in block 924. For example, continuity of heater, sensor and/or filament circuits of the ion source 161 may be detected by the processing unit 180. If various faults are detected, such as filament open, a fault may be indicated, e.g., on the display 182. Once the continuity of the inserted ion source 161 is confirmed, the probe 110 is removed to the interlock chamber 120 and the valve 140 is closed in block 926. In an embodiment, a check is automatically performed, e.g., by the processing unit 180, to confirm that the valve 140 is fully closed, following block 926 before either the purge gas or cooling gas is allowed to momentarily fill the interlock chamber 120, such that it can be opened or the ion source 161 can be removed from the vacuum chamber 150, as previously discussed. When the valve 140 is not fully closed and/or the closed status of the valve 140 cannot be verified, a fault indication is provided and the interlock chamber 120 is locked in place.

In an embodiment, the ion source 161 and various thermal zones of the system 100 are heated for a bake-out time period in block 928 prior to operating the MS 160. For example, the ion source 161 may be heated to about 320° C., the transfer line 156 may be heated to about 340° C., for example, and the analyzer/detector 162 may be heated to about 200° C. Once all zones reach the respective set temperatures, e.g., in about 3-4 minutes, they are held for the bake-out time period, which may be about eight minutes to about 20 minutes, for example. The zones are then cooled to the respective operating temperatures, which are about 230° C. for the ion source 161, about 280° C. for the transfer line and about 150° C. for the analyzer/detector 162. The cool down may take about 15 minutes, for example.

In an embodiment, the rapid heating sequence discussed above is possible because the heater and sensor are included within the removable ion source 161. For example, the heater may be a 40 W heater sandwiched between critical elements of the ion source 161, e.g., the repeller and the body. The placement of the heater allows these elements to heat ballistically and to shed residual water in a minimum amount of time. In another embodiment, the resistive circuit of the heater may be encased in a disk of sintered aluminum nitride, for example, or other ultraclean material with surface flatness properties conducive to maximum heat transfer, even in vacuum.

In block 930, the transfer line 156 is extended to connect the inlet device 155 with the ion source 161. In various embodiments, the transfer line 156 is extended automatically under control of the processing unit 180, using an air cylinder actuated via a solenoid valve, servo motors, or the like, configured to activate bellows (e.g., bellows 230), or other moveable vacuum tight coupling, such as sliding seals. Alternatively, the transfer line 156 may be extended manually using a lever (not shown), or other device, such as a wheel or a button, configured to activate bellows or other moveable vacuum tight coupling. The retractable transfer line 156 provides means to insert the transfer tip 220 of the transfer line 156 into the ion source 161 (e.g., through aperture 210).

After the thermal zones are set and the transfer line 156 is extended, a short tuning algorithm may be performed to tune the components of the MS 160, and to check for air and water. The MS 160 is then ready for operation using a new or clean ion source 161, without shutting down, cooling, venting or reheating the MS 160.

In an embodiment, the interlock chamber 120 may be removed from the vacuum chamber 150 after the ion source 161 has been replaced. For example, the purge and/or cooling gas valve(s) of the interlock chamber 120 may be opened (e.g., for about one second) in order to increase the pressure inside the interlock chamber 120. The interlock chamber 120 may then be opened and/or removed, and a cover may be attached and latched over the gate 140 and extended portion 151 of the vacuum chamber 150. Alternatively, the interlock chamber 120 may remain connected to the vacuum chamber 150, in which case the gas evacuation valve(s) may be opened to maintain a clean interlock chamber 120, ready for the next use.

Accordingly, the representative processes shown in FIGS. 5-9 enable all thermal zones of the MS 160 and the inlet device 155 to remain hot at operating temperatures and at equilibrium during removal and insertion of dirty and clean ion sources 161, or removal and insertion of different types of ion sources (e.g., EI and CI ion sources), as discussed above. In contrast, conventional maintenance requires all thermal zones to be turned off and cooled, e.g., to below 100° C. The ion source 161 of the various embodiments can therefore be replaced and run with full sensitivity within about 30 minutes or an hour, as discussed above. In addition, the high vacuum pump 170 is able to continue to operate at full speed, so that the vacuum chamber 150 and the various elements of the MS 160 can remain at operating vacuum. Further, other than the ion source 161, none of the elements of the MS 160 are exposed to contaminants or oxygen/water.

Figure 11:
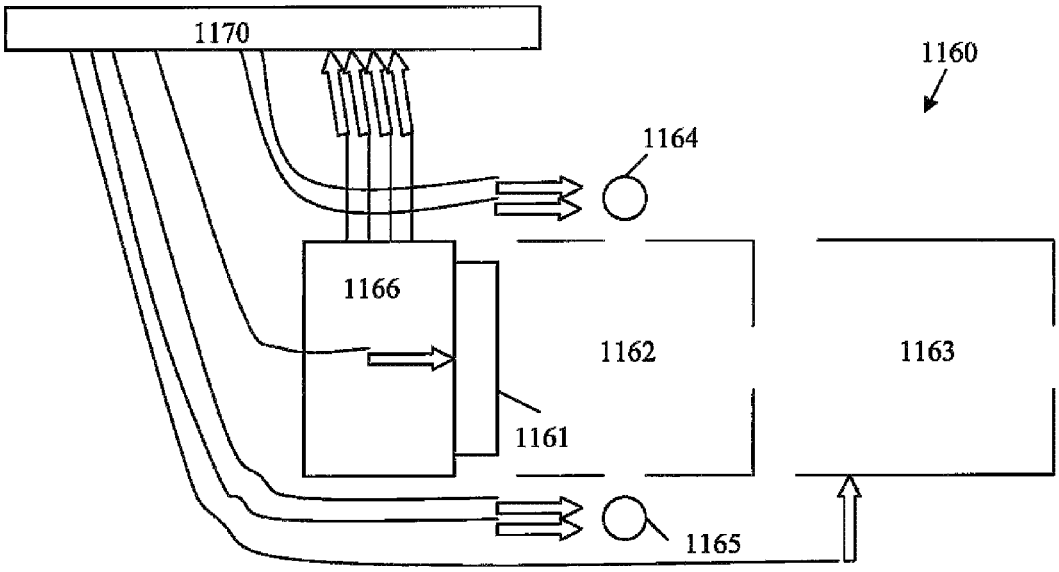
FIG. 11 Prior Art
FIG. 11 is a functional block diagram illustrating a conventional ion source.
Figure 12:
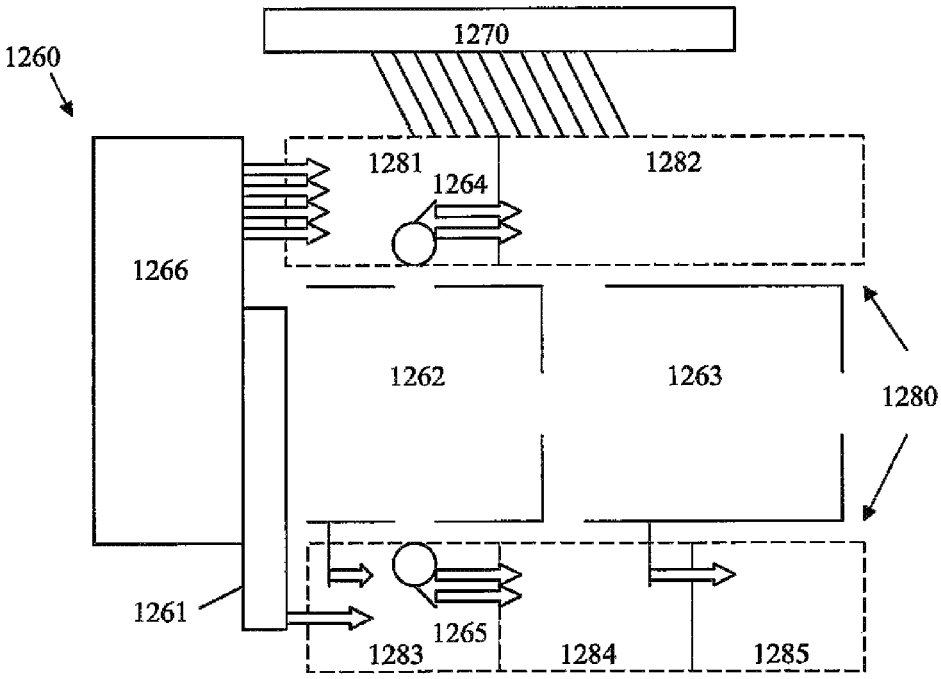
FIG. 12 is a block diagram illustrating a removable ion source of a mass spectrometry system, according to representative embodiments.

FIG. 12 is a block diagram illustrating a removable ion source of a mass spectrometry system, according to representative embodiments. FIG. 11 is a functional block diagram illustrating a conventional ion source, for comparison to the removable ion source depicted in FIG. 12.

Referring to FIG. 11, the conventional ion source 1160 includes first focusing element 1161, second focusing element 1162, third focusing element 1163 and first and second ionizing elements 1164 and 1165. Heating and sensing elements 1166 are adjacent to the first focusing element 1161. As shown, there are six leads hard wired to mass spectrometer interface circuit board 1170, which must be manually plugged into the first focusing element 1161, the third focusing element 1163 and the first and second ionizing elements 1164 and 1165, respectively, as indicated by the arrows at the ends of the leads. In addition, there are four leads hard wired to the heater and sensor elements 1166, which must be manually plugged into the interface circuit board 1170, as indicated by the arrows at the ends of the respective leads. In addition, two thumb screws (not shown) secure the ion source 1160 to the chassis of the mass spectrometer, e.g., via the second focusing element 1162.

To remove the ion source 1160 from the mass spectrometer, all of the leads must first be physically unplugged by the user from the respective elements 1161, 1163, 1164. 1165 and the interface circuit board 1170. Likewise, to insert the ion source 1160 into the mass spectrometer, all of the leads must first be physically plugged into the respective elements 1161, 1163, 1164, 1165 and the interface circuit board 1170. Manually unplugging and plugging the leads is time consuming and subject to error. Also, the mass spectrometer must be fully vented and cooled, since the user must physically reach inside the vacuum chamber in order to access the leads and/or the interface circuit board 1170. Accordingly, the ion source 1160 cannot be incorporated in the mass spectrometer systems in accordance with the various embodiments (e.g., mass spectrometer system 100*a*, 100*b* or 100*c*), since the disconnections/connections cannot be made remotely, e.g., using the probe 110.

In comparison, the removable ion source 1260 shown in FIG. 12, according to a representative embodiment, includes a docking station 1280, which has all of the leads required for operation of the ion source 1260 permanently wired to the interface circuit board 1270 of the mass spectrometer (e.g., mass spectrometer 160). The ion source 1260 includes first focusing element 1261, second focusing element 1262, third focusing element 1263 and first and second ionizing elements 1264 and 1265. Heating and sensing elements 1266 are adjacent to the first focusing element 1261.

As indicated by the respective arrows, the heating and sensing elements 1266 plug into a first section 1281 via four pins and the first ionizing element 1264 plugs into a second section 1282 of the docking station 1280 via two pins. Also, as further indicated by the respective arrows, the first and second focusing elements 1261 and 1262 plug into a third section 1283 via one pin each, the second ionizing element 1265 plugs into a fourth section 1284 via two pins, and the third focusing element 1263 plugs into a fifth section 1285 via one pin. Notably all of the arrows point in the same direction (i.e., the direction of insertion), indicating that the ion source 1260 may be electrically connected to the interface circuit board 1270 by aligning the ion source 1260 within the docking station 1280 and then sliding or pressing the ion source 1260 in the direction of insertion, so that the pins corresponding to the various elements of the ion source 1260 enter corresponding sockets of the docking station 1280. In addition, because the ion source 1260 is mechanically secured within the docking station 1280 when all of the pins have been inserted, there is no need for thumb screws, discussed above with reference to FIG. 11. The ion source 1260 is removed from the docking station 1280 by simply sliding or pulling the ion source 1260 in the opposite direction from the arrows (i.e., direction of extraction), which causes the pins corresponding to the various elements of the ion source 1260 to disconnect from the corresponding sockets of the docking station 1280.

Accordingly, the representative ion source 1260 can be inserted and connected to the docking station 1280, as well as disconnected and extracted from the docking station 1280, without the user having to physically touch the ion source 1260, the interface circuit board 1270 and/or the leads and plugs. Therefore, the ion source 1260 can be remotely inserted in and extracted from the mass spectrometer 160, e.g., using probe 110, without having to vent or cool the vacuum chamber 150, as described above. For example, the ion source 1260 can be attached to the probe 110 and removed into the interlock chamber 120, as described with reference to block 522 of FIG. 5, while maintaining the vacuum in the vacuum chamber 150. Likewise, for example, the ion source 1260 can be attached to the probe 110 and inserted into the vacuum chamber 150, as described with reference to block 920 of FIG. 9, while maintaining the vacuum in vacuum chamber 150.

Thus, according to various embodiments, an entire ion source, including the ionizing elements (e.g., two entire filament assemblies, which are consumables), and optionally a heater/sensor assembly is removable and replaceable, using a docking station, as described above. All electrical connections are robust pin/socket style connectors providing reliable connections even for the current carrying elements, such as the filament assemblies and heater. Various embodiments thus provide robust electrical connections in a removable format for elements, such as the complex filament assemblies and the heater. The ability to remove and replace a broken filament assembly, for example, provides clear advantage for a user. Inclusion of the heater (and sensor) in the removable ion source provides the means to heat quickly and reach superior performance in a minimum amount of time, further providing advantage to the user.

The ion source can be rigidly mounted to a probe, but this invention also provides the embodiment of incorporating a floating mount to manage the task of aligning the removable elements with the stationary elements. The ion source floats on the end of the probe with high degrees of both translational and rotational freedom allowing it to self-align with the docking station. For example, the ion source is coupled to the probe in a flexible manner such that the ion source can tilt and slightly move in every direction with respect to the probe. In some embodiments, the probe is configured to have a tip that rocks with respect to the rest of the probe, and the ion source is coupled to this tip. Thus, as the probe/ion source combination approaches the docking station, features of the docking station serve to guide the floating ion source and its pin contacts for exact (and reliable) engagement with the corresponding sockets of the docking station. In addition, engagement of the multiple pins and sockets serves the additional function of providing exact alignment of the focusing elements that reside on the removable ion source to the quadrupole filter that remains stationary within the mass spectrometer. Likewise, the engagement of the pins and sockets provides exact alignment of the filaments with the magnet field generated by the magnet assembly, which also remains stationary in the mass spectrometer. The ability to exactly align the removable ion source with these stationary elements critically impacts the repeatability and performance of the mass spectrometer.

Also, in order to provide quality analysis after inserting a new/clean ion source and in the most timely manner, the ion source must be baked out at least momentarily at high temperature. Therefore, the heater and heat transfer path must be fast, reliable, clean and efficient. The embodiments address the need to rapidly return to peak performance after replacement by providing a high performance heater, such as a sintered aluminum nitride heater, fastened firmly to and part of the removable ion source. Incorporating the heater/sensor into the ion source assembly optimizes heat transfer to critical elements by establishing a firm conductive thermal path, which cannot be reliably accomplished unless the heater and sensor are an integral part of the ion source assembly.

As an alternative to a full "automated and ventless" system (e.g., if the full "automated and ventless" system is cost prohibitive to some users), alternative embodiments provide a means for replacing an entire ion source, including the consumable filament assemblies, in a vented mode without the time, complexity, and risk of error involved in disconnecting and reconnecting a multitude of wires required for ion source replacement in a vented mode of a conventional system. As described above, e.g., with reference to FIG. 12, the ion source may be removed and installed without the need to remove any fasteners or wired connections in accordance with the previous discussion, when the ion source is replaced in accordance with either a ventless or vented procedure. Additionally, the high performance heater included in the ion source assembly provides the means to quickly and efficiently heat and clean the ion source, thus reaching a full performance operating condition quickly, whether or not the ion source was replaced through a ventless procedure or a vented procedure. Additionally, an ion source that has been stored in the clean storage container, as previously discussed, will more quickly reach a full performance operating condition whether or not the ion source was installed via the ventless or vented procedure.

Figure 13:
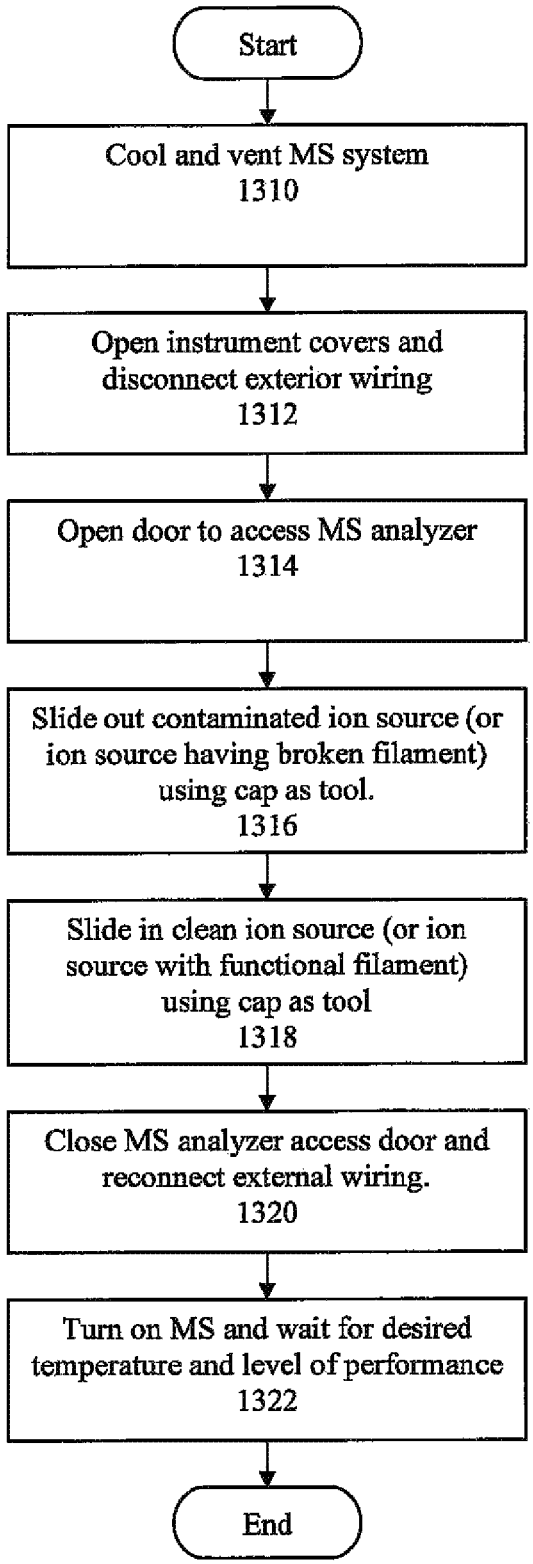
FIG. 13 is a flow diagram illustrating a method for replacing an ion source after venting a mass spectrometer, according to a representative embodiment.

FIG. 13 is a flow diagram illustrating a method for replacing an ion source after venting a mass spectrometer, according to a representative embodiment. FIGS. 14A, 14B and 14C are perspective views of a protective, clean storage container, modified cap and removable ion source, according to a representative embodiment.

Referring to FIG. 13, in order to replace ion source (e.g., ion source 161) of a mass spectrometer (e.g., MS 160), the mass spectrometer is first cooled and vented in block 1310, including cooling and venting the vacuum chamber (e.g., vacuum chamber 150). In block 1312, the instrument covers of the MS 160 are opened (manually) and any exterior wiring is disconnected. The access door for accessing the MS analyzer (e.g., analyzer/detector 162) is opened in block 1314.

In block 1316, the ion source, which is contaminated, has a broken filament, or otherwise needs to be replaced, is slid out of the MS analyzer using modified cap 1410 of the clean storage container 1420, examples of which are shown in FIGS. 14A-14C. More particularly, referring to FIG. 14A, the cap 1410 includes raised portion 1412 and connector button 1414 on an inner surface of the cap 1410. The connector button 1414 configuration may be substantially the same as the catch on the distal in of the probe 110, described above, so that the same removable ion source (e.g., ion source 161) may be used in the ventless mode and the vented mode. For example, referring to FIG. 14B, the ion source 161 is thus connected to the inner surface of the cap 1410 via the connector button 1414. The ion source 161 may then be inserted into the storage container 1420, as shown in FIG. 14C, or otherwise disposed of. Accordingly, the ion source 161 may be removed form the MS analyzer without the user having to put on clean gloves (since only the cap 1410 contacts the ion source) or without the user having to manually disconnect multiple wires (connected to conventional ion sources, as shown in FIG. 11, for example) and undo thumb screws or other securing mechanisms, as needed to remove a conventional ion source from a conventional MS analyzer.

In block 1318, a replacement ion source, which is new or clean, or has no broken filament, is slid into the MS analyzer using the cap 1410 of the clean storage container 1420. For example, the replacement ion source 161 may be previously sealed within the storage container 1420, which is a clean environment, as shown in FIG. 14C. The cap 1410, to which the replacement ion source 161 is connected, is simply removed from the clean storage container 1420, and then used as a tool to physically insert the replacement ion source 161 into the MS analyzer, without the user having to touch the replacement ion source 161. In other words, the cap 1410 may be used as a handle or tool both removing and inserting an ion source of the MS system in the vented mode. Notably, the use of the cap 1410 eliminates the need for the user to wear clean gloves during the removal or insertion process. In addition, the user does not have to manually connect multiple wires (connected to conventional ion sources, as shown in FIG. 11, for example) and reconnect thumb screws or other securing mechanisms, as needed to install a conventional ion source in a conventional MS analyzer.

After insertion of the replacement ion source 161, the MS system is turned on, and the user awaits the desired temperature and level of performance, in block 1322. As stated above, because the replacement ion source 161 is already clean, and because a high performance heater may be included in the ion source assembly in various embodiments, the MS system reach a full performance operating condition more quickly than in a conventional MS system following venting and ion source replacement.

Figure 10:
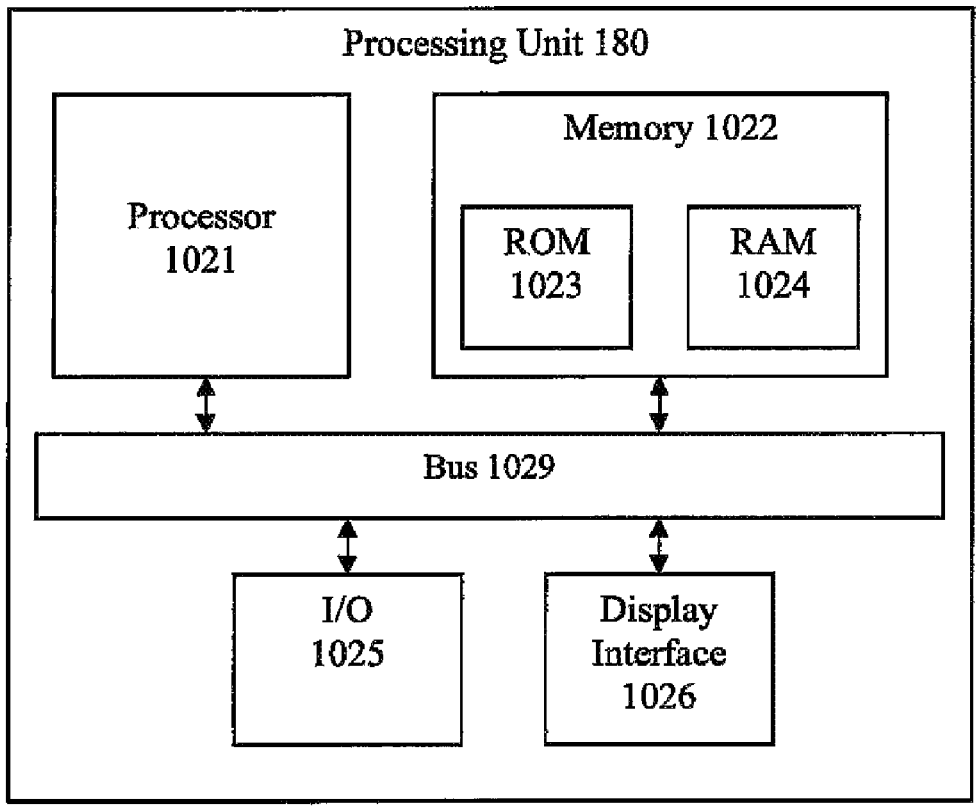
FIG. 10 is a functional block diagram showing a processing unit programmed to execute an algorithm for replacing an ion source in a mass spectrometer, according to a representative embodiment.

FIG. 10 is a functional block diagram showing a processing unit programmed to execute an algorithm for replacing an ion source in a mass spectrometer, according to a representative embodiment. That is, FIG. 10 shows one representative embodiment of the processing unit 180, which wholly or partially executes processes for removing the ion source 161 from the mass spectrometer 160, according to a representative embodiment.

The various "parts" shown in the processing unit 180 may be physically implemented using a software-controlled microprocessor, e.g., processor 1021, hard-wired logic circuits, firmware, or a combination thereof. Also, while the parts are functionally segregated in the representative processing unit 180 for explanation purposes, they may be combined variously in any physical implementation.

In the depicted embodiment, the processor 180 includes processor 1021, memory 1022, bus 1029 and interfaces 1025-1026. The processor 1021 is configured to execute one or more logical or mathematical algorithms, including the ion source removal and replacement processes according to various embodiments, in conjunction with the memory 1022. The processor 1021 may perform other processes, as well, such as controlling the basic functionality of the MS 160 and the inlet device 155 for performing mass spectrometry on various samples. The processor 1021 may be constructed of any combination of hardware, firmware or software architectures, and include its own memory (e.g., nonvolatile memory) for storing executable software/firmware executable code that allows it to perform the various functions. Alternatively, the executable code may be stored in designated memory locations within memory 1022, discussed below. In an embodiment, the processor 1021 may be a central processing unit (CPU), for example, executing an operating system, such as Windows operating systems available from Microsoft Corporation, NetWare operating system available from Novell, Inc., or Unix operating system available from Sun Microsystems, Inc. The operating system controls execution of other programs of the processing unit 180.

The memory 1022 may be any number, type and combination of nonvolatile read only memory (ROM) 1023 and volatile random access memory (RAM) 1024, and stores various types of information, such as signals and/or computer programs and software algorithms executable by the processor 1021 (and/or other components), e.g., to ion source removal and replacement operations according to various embodiments, as well as the basic functionality of geographic location determination of mobile devices. As generally indicated by ROM 1023 and RAM 1024, the memory 1022 may include any number, type and combination of tangible computer readable storage media, such as a disk drive, an electrically programmable read-only memory (EPROM), an electrically erasable and programmable read only memory (EEPROM), a CD, a DVD, a universal serial bus (USB) drive, and the like. Further, the memory 1022 may store the predetermined associations between operating temperatures of the ion source 161 and corresponding cooling periods, as discussed above with reference to block 828 of FIG. 8, for example.

Further, as discussed above, the processing unit 180 may interface with a user in order to receive commands, to present queries, to provide fault indications, and the like. For example, in the depicted embodiment of FIG. 10, the user and/or other computers may interact with the processing unit 180 using various input device(s) through I/O interface 1025 and using various display devices through display interface 1026, which may include the GUI 181, for example. The input devices may include a keyboard, key pad, a track ball, a mouse, a touch pad or touch-sensitive display, and the like.

In various embodiments, operations of FIGS. 5-9 may be implemented as processing modules executable by a device, such as the processing unit 180, according to a representative embodiment. The processing modules may be part of the processing unit 180 and/or the processor 1021, for example, and may be implemented as any combination of software, hard-wired logic circuits ware and/or firmware configured to perform the designated operations. Software modules, in particular, may include source code written in any of a variety of computing languages, such as C++, C# or Java, and are stored on tangible computer readable storage media, such the computer readable storage media discussed above with respect to memory 1022, for example. In an embodiment, the software modules may be sets of SoRware instructions executable by the processor 1021.

EXEMPLARY EMBODIMENTS

Exemplary embodiments of the present invention include, without being limited to, the following:

1. A method of replacing an ion source comprising an ionization volume, at least one ionizing element and at least one focusing element, in a mass spectrometer (MS) system comprising the ion source, a vacuum chamber that houses the ion source, and an interlock chamber, the method comprising:

opening a valve between the interlock chamber and the vacuum chamber;

moving the ion source into the interlock chamber through the opened valve and closing the valve; and removing the ion source from the interlock chamber.

2. The method of embodiment 1, further comprising:

purging the interlock chamber before opening the valve by injecting a purge gas into the interlock chamber, and evacuating the interlock chamber of the purge gas until a pressure inside the interlock chamber is below a predetermined low pressure value, while maintaining a pressure inside the vacuum chamber below the low pressure value.

3. The method of embodiment 1 or 2, further comprising:

cooling the ion source in the interlock chamber to a predetermined temperature by injecting a cooling gas into the interlock chamber, the cooling gas adjusting the pressure inside the interlock chamber to above a predetermined high pressure value.

4. The method of any one of embodiments 1-3, further comprising:

retracting a movable transfer line from engagement with the ion source before moving the ion source from the vacuum chamber, the transfer line being connected to an inlet device that provides samples to the MS system.

5. The method of any one of the above embodiments, further comprising:

determining automatically the pressure inside the interlock chamber before opening the valve between the interlock chamber and the vacuum chamber; and preventing the valve from opening when the pressure inside the interlock chamber is greater than the low pressure value.

6. The method of any one of embodiments 3-5, wherein removing the ion source from the interlock chamber comprises:

opening the interlock chamber after closing the valve, wherein the interlock chamber cannot be opened when the pressure inside the interlock chamber is below the high pressure value.

7. The method of any one of embodiments 3-6, wherein the cooling gas is the same as the purge gas.

8. The method of any one of the above embodiments, further comprising:

placing a replacement ion source into the interlock chamber;

purging the interlock chamber by injecting the purge gas into the interlock chamber;

evacuating the interlock chamber of the purge gas until the pressure inside the interlock chamber to is below the low pressure value;

opening the valve between the interlock chamber and the vacuum chamber; and moving the replacement ion source from the interlock chamber into the vacuum chamber through the opened valve and closing the valve.

9. The method of embodiment 8, further comprising:

heating the replacement ion source within the vacuum chamber to above an operating temperature for a predetermined bake-out time period; and cooling the replacement ion source within the vacuum chamber to the operating temperature after the bake-out time period—for tuning and operation.

10. The method of embodiment 4, further comprising:

placing a replacement ion source into the interlock chamber;

purging the interlock chamber by injecting the purge gas into the interlock chamber;

evacuating the interlock chamber of the purge gas until the pressure inside the interlock chamber to is below the low pressure value;

opening the valve between the interlock chamber and the vacuum chamber;

moving the replacement ion source from the interlock chamber into the vacuum chamber through the opened valve and closing the valve; and inserting the movable transfer line to engage into the ion source while maintaining the pressure inside the vacuum chamber below the low pressure value.

11. The method of embodiment 2, wherein purging the interlock chamber comprises:

opening a first valve of the interlock chamber to enable the purge gas to fill the interlock chamber, the pressure inside the interlock chamber increasing to above the high pressure value.

12. The method of embodiment 11, wherein evacuating the interlock chamber comprises:

closing the first valve of the interlock chamber;

opening a second valve of the interlock chamber to enable an initial portion of the purge gas to exit the interlock chamber, the pressure inside the interlock chamber decreasing to below a predetermined intermediate pressure value; and opening a third valve of the interlock chamber to enable an additional portion of the purge gas to exit the interlock chamber, the pressure inside the interlock chamber further decreasing to below the low pressure value.

13. The method of embodiment 12, further comprising:

indicating a fault automatically when the high pressure value is not obtained within a predetermined first time period after opening the first valve of the interlock chamber, the intermediate pressure value is not obtained within a predetermined second time period after opening the second valve of the interlock chamber, or the low pressure value is not obtained within a predetermined third time period after opening the third valve of the interlock chamber.

14. The method of embodiment 11, wherein evacuating the interlock chamber comprises:

closing the first valve of the interlock chamber; and opening a second valve of the interlock chamber to enable the purge gas to exit the interlock chamber, the pressure inside the interlock chamber decreasing to below the low pressure value.

15. The method of any one of the above embodiments, wherein moving the ion source from the interlock chamber into the vacuum chamber comprises:

activating a probe through the opened valve with the ion source engaged at a distal end of the probe, wherein the ion source floats on the distal end of the probe with translational and rotational flexibility; and sliding the probe along a longitudinal axis through the opened valve into the vacuum chamber until the ion source self-aligns with a docking station.

16. A computer readable medium that stores a program, executable by a computer processor, the program comprising codes for performing the method of any one of the above embodiments.

17. A computer readable medium that stores a program, executable by a computer processor, for replacing an ion source comprising an ionization volume, at least one ionizing element and at least one focusing element, in a mass spectrometer (MS) system, the MS system comprising a vacuum chamber, an interlock chamber and the ion source, the computer readable medium comprising:

a purging code segment for purging the interlock chamber by causing a purge gas to be injected into the interlock chamber;

an evacuating code segment for evacuating the interlock chamber of the purge gas by causing at least one outlet valve of the interlock chamber to be opened for the purge gas to escape, until a pressure inside the interlock chamber is below a predetermined low pressure value, while maintaining a pressure inside the vacuum chamber below the low pressure value;

a value control code segment for opening a valve between the interlock chamber and the vacuum chamber after the evacuation of the interlock chamber, enabling the ion source to be moved into the interlock chamber through the opened valve, and for closing the valve after the ion source is in the interlock chamber; and a cooling code segment for cooling the ion source to a predetermined temperature in the interlock chamber by causing a cooling gas to be injected into the interlock chamber, the cooling gas adjusting the pressure inside the interlock chamber to above a predetermined high pressure value, enabling the ion source to be removed from the interlock chamber.

18. The computer readable medium of embodiment 17, further comprising: a retracting code segment for causing a movable transfer line to be retracted from engagement with the ion source while maintaining the pressure inside the vacuum chamber below the low pressure value, the transfer line being connected to an inlet device that provides samples to the MS system.

19. An ion source, comprising:

an ion volume; an ionizing element; a focusing element; and wherein the ion source is configured to plug into a docking station in substantially one action, wherein the docking station provides sufficient electrical connection, upon plugging with the ion source, for operation of the ion source.

20. The ion source of embodiment 19, further comprising a heater.

21. The ion source of embodiment 18 or 19, further comprising a sensor.

22. The ion source of any one of embodiments 19-21, wherein the ionizing element is a filament assembly.

23. The ion source of any one of embodiments 19-21, comprising two filament assemblies.

24. The ion source of any one of embodiments 19-23, wherein the ion source is an electron impact or chemical ionization ion source.

25. An ion source assembly comprising the ion source of any one of embodiments 19-24 and a handle that is detachably engaged with the ion source, wherein the handle is further configured to engage a container which, when engaging the handle, encloses the ion source.

26. A mass spectrometer system comprising: the ion source of any one of embodiments 19-24; the docking station; a vacuum chamber housing the ion source; an interlock chamber; a valve operable to open the vacuum chamber to the interlock chamber; a mass analyzer; and a detector.

27. The mass spectrometer system of embodiment 26, wherein the ion source is connected to a retractable transfer line for receiving an analyte.

While specific embodiments are disclosed herein, many variations are possible, which remain within the concept and scope of the invention. Such variations would become clear after inspection of the specification, drawings and claims herein. The invention therefore is not to be restricted except within the scope of the appended claims.

What is claimed is:

1. A method of replacing an ion source comprising an ionization volume, at least one ionizing element configured to emit particles for performing collision based ionization, and at least one focusing element, in a mass spectrometer (MS) system comprising the ion source, a vacuum chamber that houses the ion source, and an interlock chamber, the method comprising:

opening a valve between the interlock chamber and the vacuum chamber;

moving the ion source from the vacuum chamber into the interlock chamber through the opened valve and closing the valve;

removing the ion source from the interlock chamber;

attaching a replacement ion source to a floating mount on a distal end of a probe, the floating mount enabling the attached replacement ion source to float with translational and rotational flexibility;

placing the replacement ion source into the interlock chamber using the probe;

opening the valve between the interlock chamber and the vacuum chamber; and moving the probe through the opened valve from the interlock chamber into the vacuum chamber until the ion source self-aligns with a docking station in the vacuum chamber, based on the translational and rotational flexibility of the floating mount on the distal end of the probe.

2. The method of claim 1, further comprising:

purging the interlock chamber before opening the valve to move the ion source from the vacuum chamber into the interlock chamber by injecting a purge gas into the interlock chamber, and evacuating the interlock chamber of the purge gas until a pressure inside the interlock chamber is below a predetermined low pressure value, while maintaining a pressure inside the vacuum chamber below the low pressure value.

3. The method of claim 2, further comprising:

cooling the ion source in the interlock chamber to a predetermined temperature by injecting a cooling gas into the interlock chamber before removing the ion source from the interlock chamber, the cooling gas adjusting the pressure inside the interlock chamber to above a predetermined high pressure value.

4. The method of claim 3, further comprising:

retracting a movable transfer line from engagement with the ion source while maintaining the pressure inside the vacuum chamber below the low pressure value, the transfer line being connected to an inlet device that provides samples to the MS system.

5. The method of claim 2, further comprising:

determining automatically the pressure inside the interlock chamber before opening the valve between the interlock chamber and the vacuum chamber; and preventing the valve from opening when the pressure inside the interlock chamber is greater than the low pressure value.

6. The method of claim 3, wherein the cooling gas is the same as the purge gas.

7. The method of claim 1, further comprising:

purging the interlock chamber by injecting the purge gas into the interlock chamber before opening the valve for moving the probe into the vacuum chamber;

evacuating the interlock chamber of the purge gas until the pressure inside the interlock chamber is below the low pressure value; and opening the valve between the interlock chamber and the vacuum chamber after the pressure inside the interlock chamber is below the low pressure value.

8. The method of claim 7, further comprising:

heating the replacement ion source within the vacuum chamber to above an operating temperature for a predetermined bake-out time period; and cooling the replacement ion source within the vacuum chamber to the operating temperature after the bake-out time period for tuning and operation before opening the value for moving the probe into the vacuum chamber.

9. The method of claim 1, wherein moving the probe from the interlock chamber into the vacuum chamber comprises:

sliding the probe along a longitudinal axis through the opened valve into the vacuum chamber until establishing electrical connection between the ion source and the docking station via at least one slidably removable connector of the ion source.

10. A computer readable medium that stores a program, executable by a computer processor, for performing the method of claim 1.

11. The method of claim 1, further comprising:

attaching the ion source to the floating mount on the distal end of the probe before moving the ion source from the vacuum chamber into the interlock chamber, enabling the attached ion source to float with translational and rotational flexibility to maintain alignment of the ion source with the docking station as the ion source is removed from the docking station.

12. An ion source, comprising:

an ion volume;

an ionizing element configured to emit particles for performing collision based ionization; and a focusing element;

wherein the ion source is configured to float with translational and rotational flexibility while attached to a distal end of a probe, enabling self-alignment of the ion source for plugging into a docking station in substantially one action when using the probe to insert the ion source from an interlock chamber into a vacuum chamber without breaking a vacuum in the vacuum chamber, and wherein the docking station provides sufficient electrical connection, upon plugging with the ion source, for operation of the ion source.

13. An ion source assembly comprising the ion source of claim 12 and a handle that is detachably engaged with the ion source, wherein the handle is further configured to engage a container which, when engaging the handle, encloses the ion source.

14. The ion source of claim 12, further comprising a heater.

15. The ion source of claim 12, further comprising a sensor.

16. The ion source of claim 12, wherein the ionizing element is a filament assembly.

17. The ion source of claim 16, comprising two filament assemblies.

18. The ion source of claim 12, wherein the ion source is an electron impact or chemical ionization ion source.

19. A mass spectrometer system comprising:

the ion source of claim 12;

the docking station;

the vacuum chamber housing the ion source when the ion source is plugged into the docking station;

an interlock chamber;

a valve operable to open the vacuum chamber to the interlock chamber;

a mass analyzer; and a detector.

20. The mass spectrometer system of claim 19, wherein the ion source is connected to a retractable transfer line for receiving an analyte.

* * * * *